US011653799B2

(12) United States Patent
Burgess et al.

(10) Patent No.: US 11,653,799 B2
(45) Date of Patent: May 23, 2023

(54) ADAPTER FOR VACUUM CLEANER ASSEMBLY

(71) Applicant: TECHTRONIC CORDLESS GP, Anderson, SC (US)

(72) Inventors: Roderick Burgess, Charlotte, NC (US); Jacob W. Connelly, Concord, NC (US); Kevin Terry, Charlotte, NC (US); Bradley Hooley, Charlotte, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 191 days.

(21) Appl. No.: 17/129,510

(22) Filed: Dec. 21, 2020

(65) Prior Publication Data

US 2021/0204767 A1 Jul. 8, 2021

Related U.S. Application Data

(60) Provisional application No. 62/956,752, filed on Jan. 3, 2020.

(51) Int. Cl.

| | |
|---|---|
| ***A47L 5/22*** | (2006.01) |
| ***A47L 5/28*** | (2006.01) |
| ***A47L 9/32*** | (2006.01) |

(52) U.S. Cl.

CPC ..... *A47L 5/225* (2013.01); *A47L 5/28* (2013.01); *A47L 9/322* (2013.01); *A47L 9/325* (2013.01)

(58) Field of Classification Search

CPC . A47L 5/225; A47L 5/28; A47L 9/322; A47L 9/325; A47L 5/24; A47L 9/2884; A47L 9/2868; A47L 11/4005; A47L 9/0416; A47L 9/0433; A47L 9/32; A47L 11/4075; A47L 9/009

(Continued)

(56) References Cited

U.S. PATENT DOCUMENTS

| | | | |
|---|---|---|---|
| 4,644,605 | A | 2/1987 | Joss et al. |
| 5,031,266 | A | 7/1991 | Tillman et al. |

(Continued)

FOREIGN PATENT DOCUMENTS

| | | | |
|---|---|---|---|
| CN | 103545885 | A | 1/2014 |
| CN | 104939744 | A | 9/2015 |

(Continued)

OTHER PUBLICATIONS

International Search Report and Written Opinion for Application No. PCT/US2020/066460 dated Apr. 23, 2021 (13 pages).

*Primary Examiner* — Don M Anderson
*Assistant Examiner* — Jason Khalil Hawkins
(74) *Attorney, Agent, or Firm* — Michael Best & Friedrich LLP

(57) ABSTRACT

A vacuum cleaner assembly includes an upright vacuum cleaner, an adapter, and a handheld accessory. The upright vacuum cleaner includes an upright frame and a connection post. The connection post is coupled to the upright frame. The connection post includes a distal end. The adapter includes a recess and a projection. The distal end of the connection post is removably received in the recess. The projection is opposite the recess. The handheld accessory includes an elongate member. The elongate member includes a nozzle end. At least a portion of the projection is removably received in the nozzle end.

27 Claims, 16 Drawing Sheets

(58) Field of Classification Search
USPC ..... 15/329, 1.51, 389, 363, 335
See application file for complete search history.

(56) References Cited

U.S. PATENT DOCUMENTS

| | | | | |
|---|---|---|---|---|
| 6,122,796 | A | 9/2000 | Downham et al. | |
| 6,574,831 | B2 | 6/2003 | Hunter et al. | |
| 6,631,535 | B2 | 10/2003 | Sergyeyenko et al. | |
| 7,247,181 | B2 | 7/2007 | Hansen et al. | |
| 7,350,263 | B2 * | 4/2008 | Yoshimi | A47L 5/32 15/334 |
| 7,377,007 | B2 | 5/2008 | Best | |
| 8,225,457 | B2 | 7/2012 | Sanderson et al. | |
| 8,365,350 | B2 | 2/2013 | Cochran et al. | |
| 8,424,154 | B2 | 4/2013 | Beskow et al. | |
| 8,607,406 | B2 | 12/2013 | Miefalk et al. | |
| 8,671,510 | B2 | 3/2014 | Han et al. | |
| 8,677,554 | B2 | 3/2014 | Conrad | |
| 8,769,764 | B2 | 7/2014 | Crouch et al. | |
| 9,254,069 | B2 * | 2/2016 | Kim | A47L 5/28 |
| 9,675,218 | B2 | 6/2017 | Kim et al. | |
| 9,757,001 | B2 | 9/2017 | Hwang et al. | |
| 9,901,228 | B2 | 2/2018 | Conrad | |
| 9,962,046 | B2 | 5/2018 | Rowntree | |
| 10,105,022 | B2 * | 10/2018 | Li | A47L 5/225 |
| 10,154,765 | B2 | 12/2018 | Khalil | |
| 10,213,074 | B2 | 2/2019 | Jenson | |
| 10,314,453 | B2 | 6/2019 | Kim et al. | |
| 11,229,332 | B2 * | 1/2022 | Li | A47L 5/225 |
| 2003/0019072 | A1 | 1/2003 | Houghton et al. | |
| 2005/0125940 | A1 | 6/2005 | McDowell et al. | |
| 2005/0273969 | A1 | 12/2005 | Watson et al. | |
| 2006/0026788 | A1 * | 2/2006 | Fischer | A47L 9/325 15/334 |
| 2006/0282976 | A1 * | 12/2006 | Richardson | A47L 9/244 15/334 |
| 2007/0136984 | A1 | 6/2007 | Hsu | |
| 2007/0226947 | A1 | 10/2007 | Kang | |
| 2008/0040883 | A1 | 2/2008 | Beskow et al. | |
| 2009/0000054 | A1 * | 1/2009 | Hampton | A47L 9/26 15/323 |
| 2011/0289720 | A1 | 12/2011 | Han et al. | |
| 2012/0030896 | A1 | 2/2012 | Crouch et al. | |
| 2014/0237752 | A1 * | 8/2014 | Conrad | A47L 9/2847 15/353 |
| 2014/0237754 | A1 * | 8/2014 | Conrad | A47L 9/00 15/328 |
| 2015/0040342 | A1 * | 2/2015 | Henderson | A47L 5/32 15/363 |
| 2018/0035854 | A1 | 2/2018 | Thorne | |
| 2018/0084964 | A1 | 3/2018 | Pi et al. | |
| 2018/0303303 | A1 | 10/2018 | Nyberg et al. | |
| 2019/0008337 | A1 | 1/2019 | Lim et al. | |
| 2019/0008341 | A1 | 1/2019 | Conrad | |
| 2019/0133394 | A1 | 5/2019 | Kim et al. | |

FOREIGN PATENT DOCUMENTS

| | | | |
|---|---|---|---|
| CN | 204722967 | U | 10/2015 |
| CN | 105266722 | A | 1/2016 |
| CN | 106923745 | A | 7/2017 |
| CN | 108283459 | A | 7/2018 |
| CN | 108309148 | A | 7/2018 |
| CN | 108888174 | A | 11/2018 |
| CN | 109199220 | A | 1/2019 |
| CN | 109199225 | A | 1/2019 |
| CN | 109464063 | A | 3/2019 |
| CN | 208582324 | U | 3/2019 |
| CN | 208677258 | U | 4/2019 |
| CN | 208677259 | U | 4/2019 |
| DE | 102008007985 | A1 | 8/2009 |
| DE | 202009017028 | U1 | 3/2010 |
| GB | 2307848 | A | 6/1997 |
| JP | H04364822 | A | 12/1992 |
| WO | 2014001502 | A1 | 1/2014 |
| WO | 2015189563 | A1 | 12/2015 |
| WO | 2016135167 | A1 | 9/2016 |
| WO | 2018065068 | A1 | 4/2018 |
| WO | 2018065069 | A1 | 4/2018 |

* cited by examiner

ADAPTER FOR VACUUM CLEANER ASSEMBLY

CROSS-REFERENCE TO RELATED APPLICATIONS

This application claims priority to U.S. Provisional Patent Application No. 62/956,752, filed Jan. 3, 2020, the entire contents of which are hereby incorporated by reference herein.

BACKGROUND

The present disclosure relates to a vacuum cleaner assembly. Particularly, the present disclosure relates to an adapter for use with an upright vacuum cleaner and a handheld accessory.

SUMMARY

In one embodiment, the disclosure provides a vacuum cleaner assembly including an upright vacuum cleaner, an adapter, and a handheld accessory. The upright vacuum cleaner includes an upright frame and a connection post. The connection post is coupled to the upright frame. The connection post includes a distal end. The adapter includes a recess and a projection. The distal end of the connection post is removably received in the recess. The projection is opposite the recess. The handheld accessory includes an elongate member. The elongate member includes a nozzle end. At least a portion of the projection is removably received in the nozzle end.

In another embodiment, the disclosure provides an adapter for use with a vacuum cleaner assembly. The adapter includes an upright vacuum cleaner engagement end, a handheld accessory engagement end, a peripheral wall, a shoulder, and a retainer member. The upright vacuum cleaner engagement end includes a recess defined therein. The recess is formed to receive a portion of an upright vacuum cleaner. The handheld accessory engagement end is opposite the upright vacuum cleaner engagement end. The handheld accessory engagement end includes a projection. The projection is formed to be received in a nozzle of a handheld accessory. The peripheral wall surrounds the recess. The peripheral wall includes an adapter outer surface. The retainer member extends substantially parallel to the projection. The retainer member includes a tooth extending toward the projection.

In another embodiment, the disclosure provides a vacuum cleaner assembly. The vacuum cleaner assembly includes an upright vacuum cleaner, a handle attachment, and an adapter. The handle attachment includes a handle and a handle shaft. The handle shaft is coupled to the handle. The handle shaft removably couples to the upright vacuum cleaner. The adapter removably couples to the upright vacuum cleaner and removably couples to a handheld accessory.

Before any embodiments of the disclosure are explained in detail, it is to be understood that the disclosure is not limited in its application to the details of construction and the arrangement of components set forth in the following description or illustrated in the accompanying drawings. The disclosure is capable of other embodiments and of being practiced or of being carried out in various was. Other aspects of the disclosure will become apparent by consideration of the detailed description and accompanying drawings.

DETAILED DESCRIPTION

Figure 1:
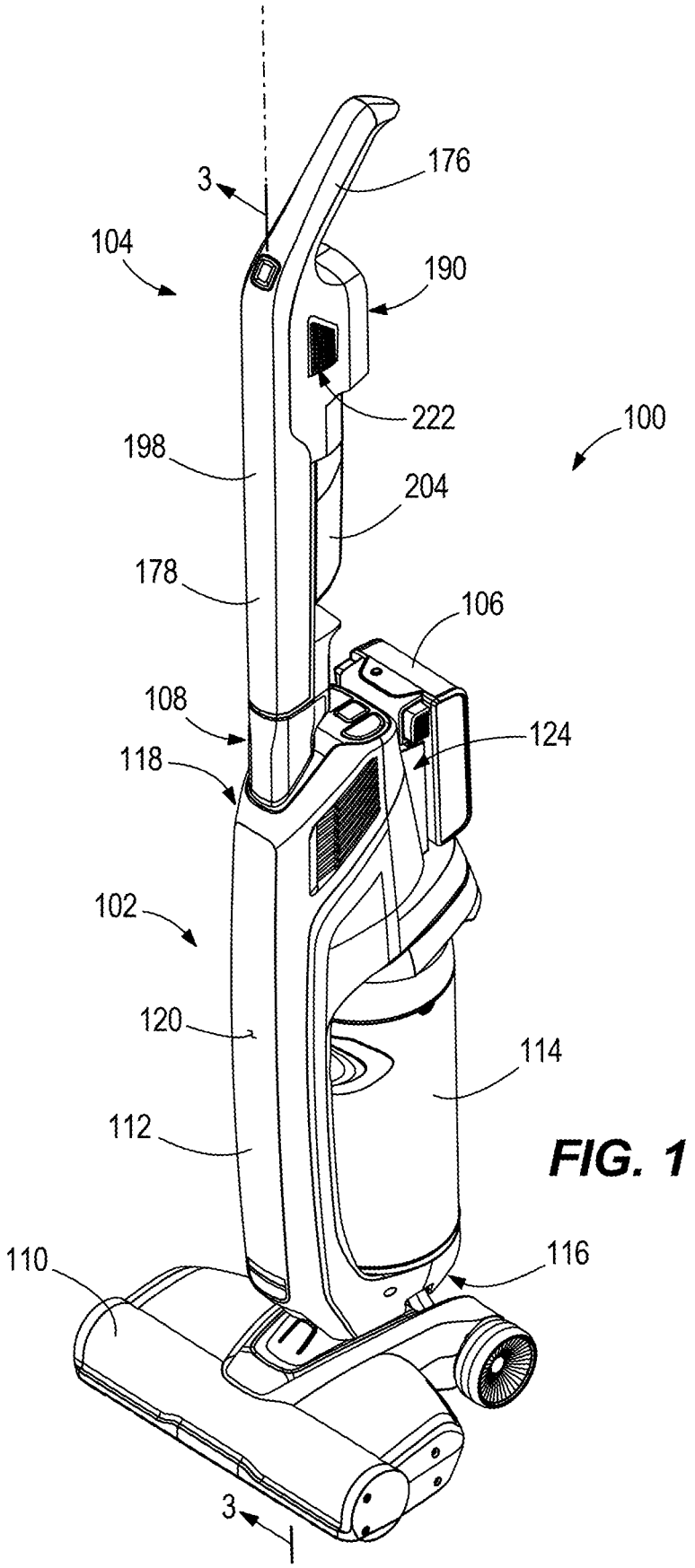
FIG. 1 illustrates a perspective view of a vacuum cleaner assembly, according to embodiments described herein.

Referring to FIG. 1, a vacuum cleaner assembly 100 is shown. The vacuum cleaner assembly 100 includes an upright vacuum cleaner 102, a handheld accessory 104, and a battery 106. In some embodiments, the vacuum cleaner assembly 100 further includes an adapter 108 removably coupling the handheld accessory 104 to the upright vacuum cleaner 102. In some embodiments, the battery 106 is usable interchangeably between the vacuum cleaner 102 and the handheld accessory 104. This interchangeability may allow a user to purchase/own only one battery 106 for multiple cleaning applications. Further, this interchangeability can reduce the overall weight of the vacuum cleaner assembly 100, since only one battery 106 need be included.

As shown in FIG. 1, the upright vacuum cleaner 102 includes a cleaning head 110, an upright frame 112 pivotably connected to the cleaning head 110, and a dirt cup 114. The upright frame 112 includes a pivot end 116 and a handheld end (or engagement end) 118 opposite the pivot end 116. The cleaning head 110 is pivotably connected to the upright frame 112 adjacent the pivot end 116. The upright frame 112 defines a longitudinal axis A1 extending through the pivot end 116 and the handheld end 118. The upright frame 112 also includes a leading surface 120 (FIG. 1) and a trailing surface 122 (FIG. 2) opposite the leading surface 120. The leading surface 120 is forward of the trailing surface 122 in a forward direction of the upright vacuum cleaner 102 during operation.

Figure 2:
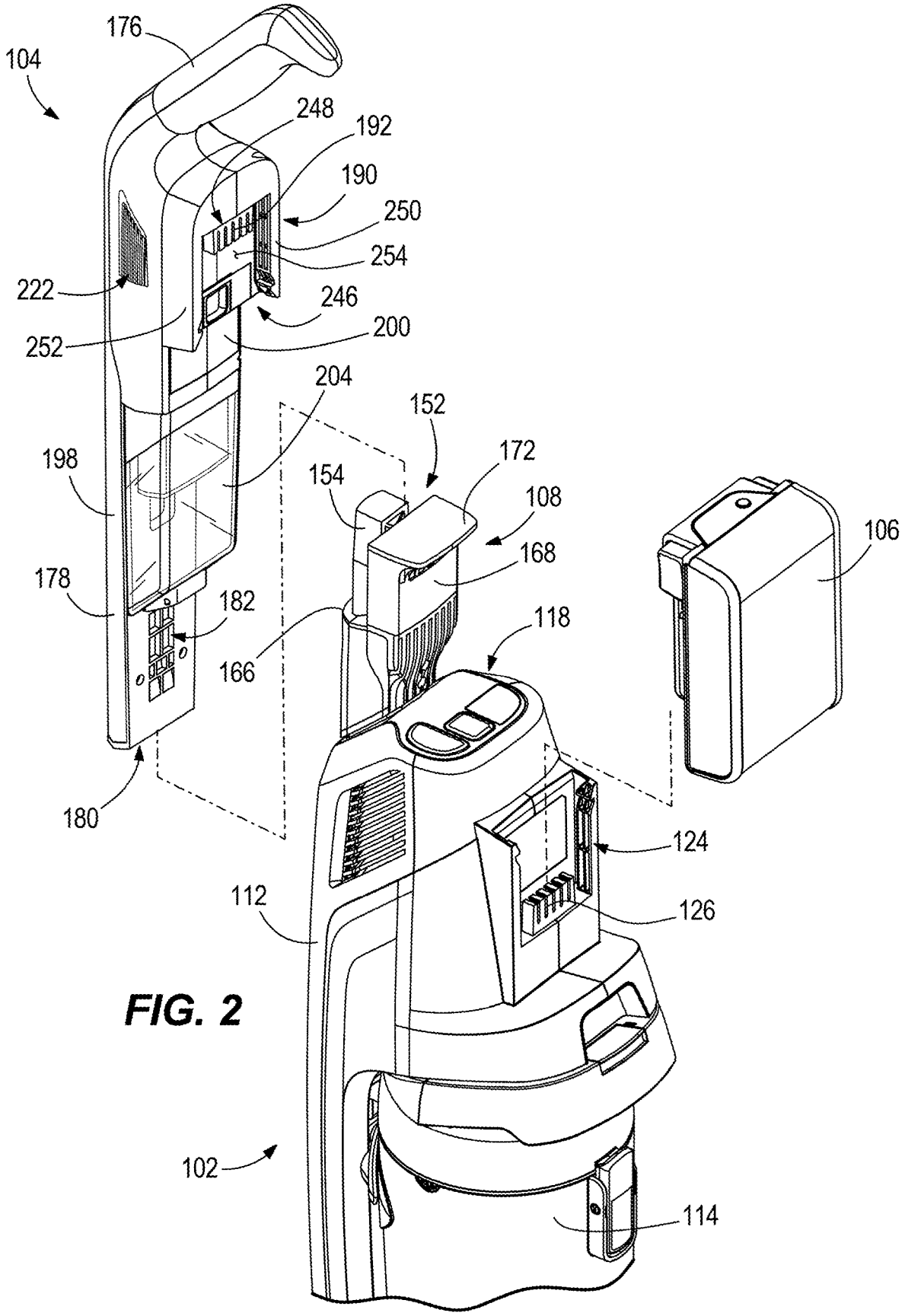
FIG. 2 illustrates a detailed perspective view of the vacuum cleaner assembly of FIG. 1 with the handheld accessory and the battery exploded from the upright vacuum cleaner.

With reference to FIG. 2, the upright vacuum cleaner 102 further includes a first battery mount 124. The first battery mount 124 is illustrated as being connected to the upright frame 112, but the first battery mount 124 may alternatively be connected to the cleaning head 110. The first battery mount 124 includes a first battery connection terminal 126. In the embodiment illustrated in FIG. 2, the first battery mount 124 includes a plurality of first battery connection terminals 126. The battery 106 is removably coupled to the first battery mount 124. In some embodiments, the battery 106 is slidably received on the first battery mount 124 in a direction extending along the longitudinal axis A1 of the upright frame 112. In the illustrated embodiment, the battery 106 is slidably received on the first battery mount 124 in a direction extending parallel with the longitudinal axis A1. With the battery 106 removably coupled to the first battery mount 124 and electrically coupled to the first battery connection terminal 126, the battery 106 powers at least one operating component of the upright vacuum cleaner 102. The operating component may be, for example, a suction motor, brushroll motor, a pump, a valve, an actuator, a microprocessor, a controller, or other operating component.

Figure 3:
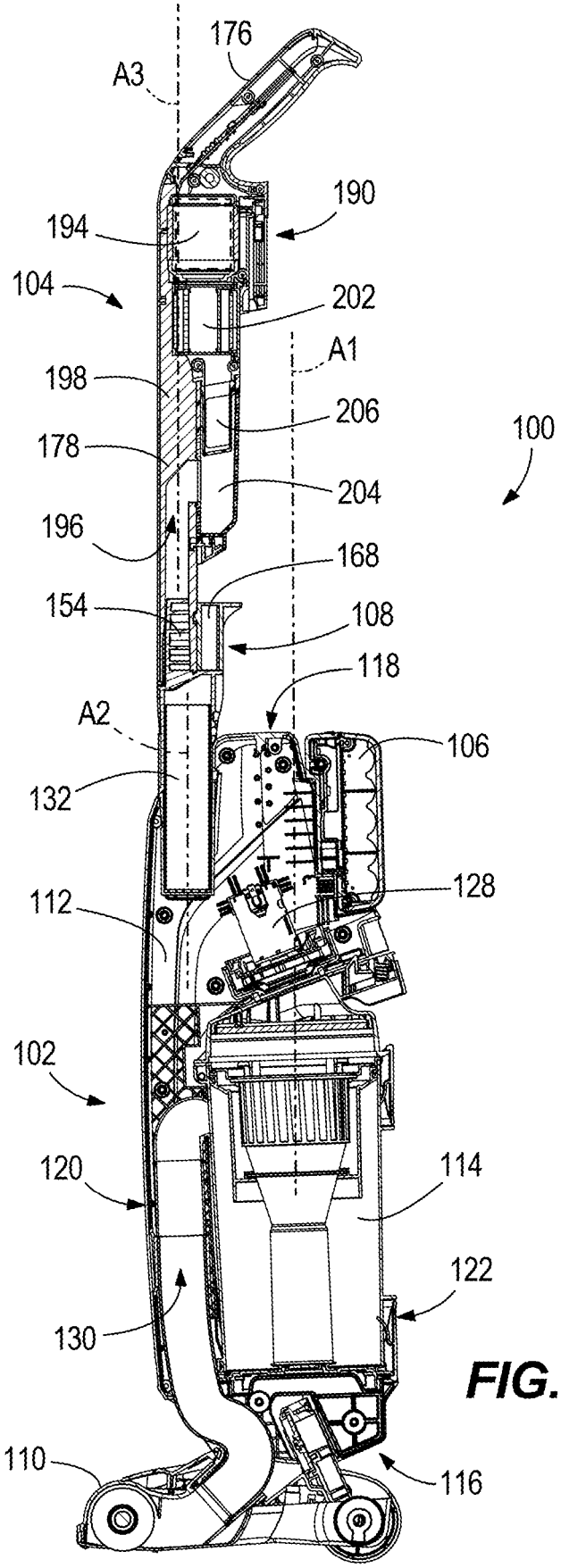
FIG. 3 illustrates a cross-sectional view of the vacuum cleaner assembly taken along line 3-3 of FIG. 1.

As shown in FIG. 3, the upright vacuum cleaner 102 further includes a first operating component as a first motor 128. The first motor 128 drives a first impeller (not shown) to generate airflow. In embodiments including the first motor 128 driving the first impeller, the first motor 128 may also be considered to be a first suction motor. With the battery 106 coupled to the first battery mount 124 and electrically coupled to the first battery connection terminal 126, the first motor 128 is electrically coupled to and powered by the battery 106.

Also shown in FIG. 3, a flow passage, or first airflow pathway, 130 passes through the cleaning head 110 and is in fluid communication with the dirt cup 114. This flow passage 130 is isolated from the handheld accessory 104. The first motor 128 creates suction to draw air and dirt through the flow passage 130 and into the dirt cup 114. A dirt separator within the dirt cup 114 separates dirt and debris from the incoming air stream, collects the separated dirt within a dirt collection chamber, and directs the clean air to the motor 128, from which it will be exhausted to ambient. In the illustrated embodiment, the dirt separator is a cyclonic dirt separator. The dirt cup 114 is removable and includes a bottom door that is selectively openable by pivoting to empty the debris from the dirt collection chamber when the dirt collection chamber is full.

Figure 4:
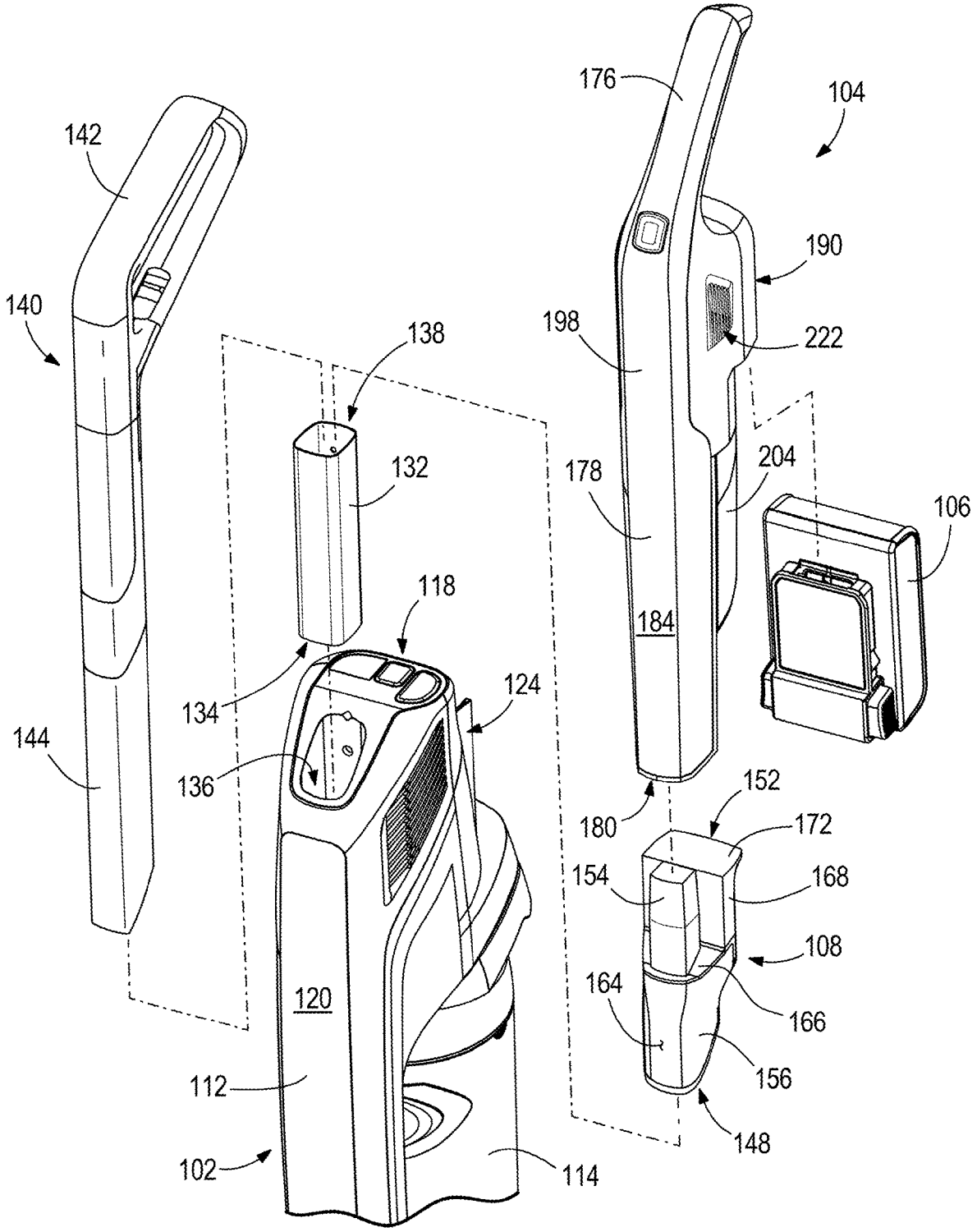
FIG. 4 illustrates a detailed perspective view of the vacuum cleaner assembly of FIG. 1 with the handheld accessory, adapter, and battery exploded from the upright vacuum cleaner and an optional handle shaft exploded from the upright vacuum cleaner.

As shown in FIG. 4, the upright vacuum cleaner 102 further includes a connection post 132 coupled to the upright frame 112. In some embodiments, the connection post 132 is integrally formed with the upright frame 112. In the illustrated embodiment, the connection post 132 is removably coupled to the upright frame 112. The connection post 132 includes a proximal end 134 that is received within a connection opening 136 of the upright frame 112. The connection post 132 further includes a distal end 138 that is opposite the proximal end 134.

In some embodiments, the vacuum cleaner assembly 100 further includes a handle attachment 140 removably coupled to the upright vacuum cleaner 102. The handle attachment 140 includes a handle 142 and a handle shaft 144 coupled to the handle 142. In the illustrated embodiment, the handle shaft 144 is removably coupled to the connection post 132. In some embodiments, however, the handle shaft 144 is removably coupled to the upright frame 112 in the connection opening 136.

The connection post 132, in some embodiments, includes one or more fasteners to removably couple the connection post 132 to either the adapter 108 or the handle attachment 140. The fasteners may include, for instance, one or more detent mechanisms. These fasteners pass through one or more through holes 146 defined in the connection post 132. In some embodiments, the adapter 108 is not removable from the connection post 132 and is integral with or otherwise fastened to the connection post 132.

Also shown in FIG. 4, the vacuum cleaner assembly 100 further includes the adapter 108 removably coupled to the upright vacuum cleaner 102. The adapter 108, in some embodiments, is formed as a single unitary part. The adapter 108 is also removably coupled to the handheld accessory 104. In the illustrated embodiment, the vacuum cleaner assembly 100 is arranged such that only one of the handle shaft 144 and the adapter 108 is able to removably couple to the upright vacuum cleaner 102 at a time.

Figure 7:
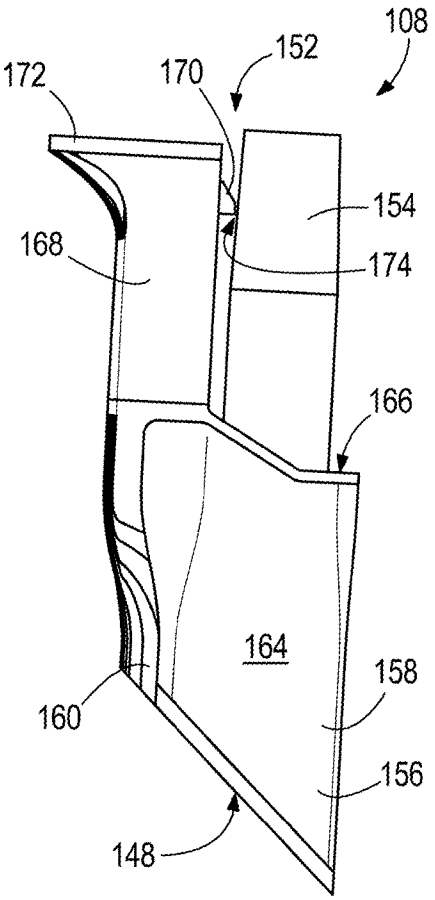
FIG. 7 illustrates a side elevation view of the adapter of FIG. 5.
Figure 6:
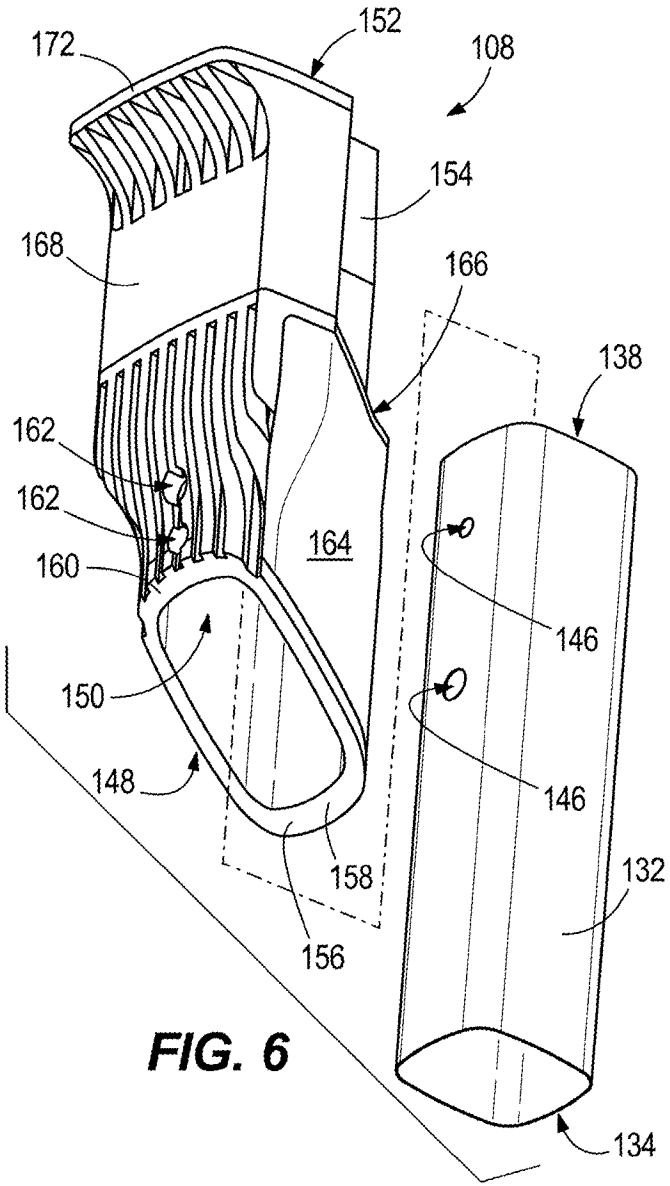
FIG. 6 illustrates a rear perspective view of the adapter of FIG. 5.
Figure 5:
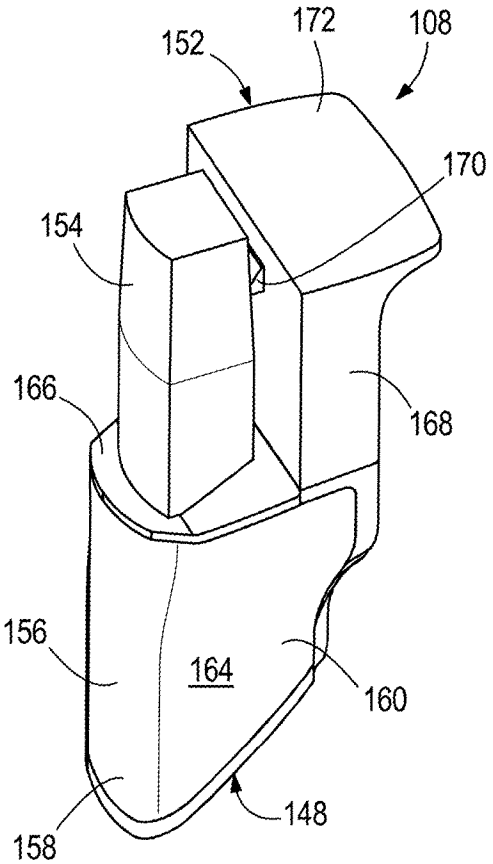
FIG. 5 illustrates a front perspective view of the adapter of the vacuum cleaner assembly of FIG. 1.

With reference to FIGS. 5-7, the adapter 108 includes an adapter body having an upright vacuum cleaner engagement end 148 configured to connect the adapter 108 to a portion of the upright vacuum cleaner 102. In the illustrated embodiment, the upright vacuum cleaner engagement end 148 has a recess 150 defined therein. The recess 150 is sized to removably receive the distal end 138 of the connection post 132. The adapter 108 further includes a handheld accessory engagement end 152 opposite the upright vacuum cleaner engagement end 148. The handheld accessory engagement end 152 includes a projection 154. Stated another way, the projection 154 is positioned opposite the recess 150. A longitudinal axis A2 of the adapter 108 extends through the upright vacuum cleaner engagement end 148 and the handheld accessory engagement end 152. In the illustrated embodiment, the recess 150 is open in a direction extending along the longitudinal axis A2. The projection 154 also extends in a direction along the longitudinal axis A2. In some embodiments, the longitudinal axis A2 extends along longitudinal axis A1 such that the projection 154 also extends away from the upright frame 112 along the longitudinal axis A1. In some embodiments, at least a portion of the free end of the projection 154 is tapered.

The adapter 108 further includes a peripheral wall 156 about the adaptor body between the handheld accessory engagement end 152 and the upright vacuum cleaner engagement end 148 surrounding the recess 150 and extending in a direction along the longitudinal axis A2. The peripheral wall 156 also includes a first peripheral wall portion 158 and a second peripheral wall portion 160. The first peripheral wall portion 158 is longer along the longitudinal axis A2 than the second peripheral wall portion 160. This difference in lengths creates an angled recess 150 to match the contours of the upright frame 112 in the illustrated embodiment.

The peripheral wall 156 further includes at least one aperture 162 defined therein. The at least one aperture 162 receives a fastener therethrough, thereby coupling the adapter 108 to the connection post 132. In some embodiments, a detent mechanism coupled to the connection post 132 at least partially occupies the aperture 162 when the adapter 108 is coupled to the connection post 132.

The peripheral wall 156 also has an adapter outer surface 164. The adapter outer surface 164 is arranged in a stepped configuration relative to the projection 154 such that a shoulder 166 extends laterally between the projection 154 and the adapter outer surface 164. The shoulder 166 surrounds the projection 154 in the illustrated embodiment. Also in the illustrated embodiment, at least a portion of the shoulder 166 is inclined relative to a direction extending perpendicular to the longitudinal axis A2 of the adapter 108.

The adapter 108 also includes a retainer member 168. The retainer member 168 extends in a direction along the projection 154. In some embodiments, the retainer member 168 is aligned with the second peripheral wall portion 160 in a direction along the longitudinal axis A2 of the adapter 108. In the illustrated embodiment, retainer member 168 extends parallel to the projection 154. The retainer member 168 includes at least one tooth 170 extending toward the projection 154. The retainer member 168 also includes a user-engageable actuator, such as a tab 172. A user can engage the tab 172 or another user-engageable actuator to move the at least one tooth 170 away from the projection 154, such as by sliding or pivoting movement. In the illustrated embodiment, the retainer member 168 and the tooth 170 pivot away from the projection 154 together. In some embodiments, the tooth 170 is movable relative to the retainer member 168. The tab 172 extends in a direction away from the projection 154. In the illustrated embodiment, a gap 174 is defined between the tooth 170 and the projection 154. User engagement to move the at least one tooth 170 away from the projection 154 widens the gap 174. In some embodiments, the tooth 170 moves against the force of a spring or other resilient member configured such that the spring presses the tooth 170 toward its rest or seated position.

Returning to FIG. 2, the vacuum cleaner assembly 100 further includes the handheld accessory 104 removably coupled to the upright frame 112. In the illustrated embodiment, the handheld accessory (illustrated as a handheld vacuum cleaner) 104 is coupled to the adapter 108 which, in turn, is coupled to the upright frame 112. The handheld accessory 104 is coupled to the upright frame 112 nearer the handheld end 118 than the pivot end 116. Specifically, the handheld accessory 104 projects beyond the handheld end 118 of the upright frame 112 in a direction away from the pivot end 116 when the handheld accessory 104 is coupled to the upright frame 112.

The handheld accessory 104 includes a handle 176 having a grip portion. With the handheld accessory 104 coupled to the upright frame 112, the handle 176 functions as the handle for the upright vacuum cleaner 102. With the handheld accessory 104 removed from the upright frame, the handle 176 functions as the handle for the handheld accessory 104. In the illustrated embodiment, the handle 176 is a pistol grip style handle.

The handheld accessory 104 further includes an elongate structural member 178 having a nozzle, or nozzle end, 180. The handle 176 of the handheld accessory 104 is opposite the nozzle end 180, and the handle 176 extends at an angle relative to a longitudinal axis A3 of the elongate structural member 180. In the illustrated embodiment, the elongate structural member 178 includes a body portion 178A that extends from the nozzle end 180 and a tang portion 178B that extends from the body portion 178A and into the grip portion of the handle 176. In some embodiments, the elongate structural member 178 is a continuous, unitary part.

In the illustrated embodiment, the handle 176 of the handheld accessory 104 extends along a direction that is at an angle of about 45 degrees relative to the longitudinal axis A3. In some embodiments, the handle 176 extends along a direction that is at an angle between 10 and 90 degrees relative to the longitudinal axis A3, and more particularly at an angle between 30 and 60 degrees. With the handheld accessory 104 connected to the upright frame 112, the handle 176 extends at an angle relative to the longitudinal axis A1 of the upright frame 112. To connect the handheld accessory 104 to the adapter 108, at least a portion of the projection 154 is removably received in the nozzle end 180. As such, the nozzle 180 is substantially blocked when the handheld accessory 104 is coupled to the upright frame 112.

As shown in FIG. 3, with the projection 154 received in the nozzle end 180, the retainer member 168 engages the handheld accessory 104. In the illustrated embodiment, the at least one tooth 170 engages the handheld accessory 104 by entering a corresponding cavity 182 defined in an elongate structural member outer surface 184 of the passage wall 186 of the elongate structural member 178 (shown in FIG. 2). The passage wall 186 extends from the nozzle end 180, and at least a portion of the passage wall 186 includes a passage wall thickness 188 that is thicker than the gap 174 between the tooth 170 and the projection 154. In the illustrated embodiment, this difference in thickness forces the at least one tooth 170 into engagement with the handheld accessory 104. The at least one tooth 170 is forced into engagement with the handheld accessory 104 by a resilient member (such as a spring) or by flexing the retainer member 168 such that the retainer member 168 exhibits a return force. To remove the handheld accessory 104 from the adapter 108 in the illustrated embodiment, a user actuates the tab 172 to move the retainer member 168, thereby disengaging the at least one tooth 170 from the handheld accessory 104.

In the illustrated embodiment, the adapter 108 and the handheld accessory 104 are sized such that the adapter outer surface 164 is generally flush with the elongate structural member outer surface 184. Stated another way, these surfaces 164, 184 form a substantially tangential transition. The nozzle 180 is further angled in a manner that matches the incline of the shoulder 166. In the illustrated embodiment, the handheld accessory 104 further is coupled to the upright frame 112 such that the elongate structural member 178 is nearer the leading surface 120 than the trailing surface 122. In some embodiments, at least a portion of the elongate structural member outer surface 184 is substantially aligned with the leading surface 120 of the upright frame 112. This continuity of surfaces between the upright frame 112, the adapter 108, and the handheld accessory 104 is aesthetically pleasing and functions to give the vacuum cleaner assembly 100 sturdiness and a sleek appearance.

When the handle 176 of the handheld accessory 104 functions as the handle for the upright vacuum cleaner 102, forces applied to the handle 176 for manipulating the upright vacuum cleaner 102 are transferred through the elongate structural member 178, the nozzle end 180, and the adaptor 108 to the upright frame 112. The novel improvement disclosed with the continuous elongate structural member 178 extending from the nozzle end 180 into the grip portion of the handle 176 and the projection 154 removably received in the nozzle end 180 is advantageous over prior art connections in providing a sturdy connection between the user-manipulable grip and the upright frame 112 while achieving a desired appearance. In some embodiments, the assembled vacuum cleaner assembly 100 resembles a single upright vacuum cleaner with no accessories, while still offering a detachable handheld accessory 104.

Referring to FIG. 2, the handheld accessory 104 further includes a second battery mount 190. In the illustrated embodiment, the second battery mount 190 is identical to the first battery mount 124. As such, the second battery mount 190 includes at least one second battery connection terminal 192. The battery 106 removably couples to the second battery mount 190 to power at least one operating component of the handheld accessory 104. The operating component may be, for example, a suction motor, brushroll motor, a pump, a valve, an actuator, a microprocessor, a controller, or other operating component. In some embodiments, the battery 106 is slidably received on the second battery mount 190 in a direction extending along the longitudinal axis A3 of the elongate structural member 178. In the illustrated embodiment, the battery 106 is slidably received on the second battery mount 190 in a direction extending parallel with the longitudinal axis A3.

As shown in FIG. 3, the handheld accessory 104 also includes a second operating component as a second motor 194. The second motor 194 drives a second impeller (not shown) to generate airflow. In embodiments including the second motor 194 driving the second impeller, the second motor 194 may also be considered to be a second suction motor. The second motor 194 is electrically coupled to and powered by the battery 106 when the battery is coupled to the second battery mount 190 and electrically coupled to the at least one second battery connection terminal 192.

When the battery 106 is coupled to the first battery mount 124, only the first motor 128 is electrically coupled to the battery 106; the second motor 194 receives no electric power. When the battery 106 is coupled to the second battery mount 190, only the second motor 194 is electrically coupled to the battery 106; the first motor 128 receives no electric power. Stated another way, the battery 106 powers only one of the first motor 128 (when the battery 106 is coupled to the first battery mount 124) and the second motor 194 (when the battery 106 is coupled to the second battery mount 190) at a time, being interchangeable between the vacuum cleaner 102 and the handheld accessory 104.

Figure 8:
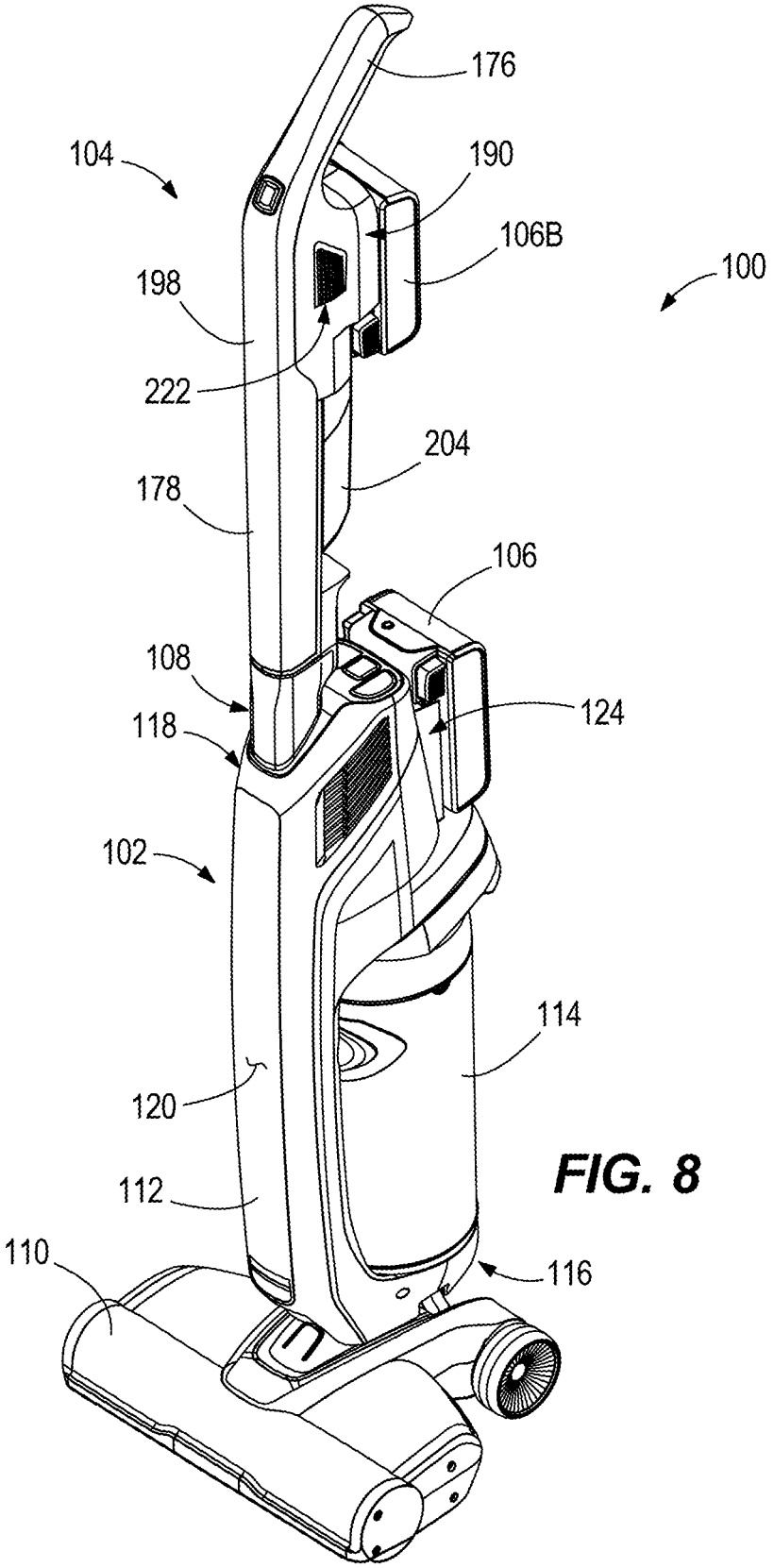
FIG. 8 illustrates a perspective view of the vacuum cleaner assembly of FIG. 1 with an additional battery.

As shown in FIG. 8, in some embodiments, a second battery 106B is provided interchangeable with the battery 106, and the first battery mount 124 and the second battery mount 190 are configured to receive one of the battery 106 and the second battery 106B. Providing the second battery 106B onboard interchangeable with the battery 106 gives the user the ability to exchange, for example, the second battery 106B for the battery 106 when the battery 106 is depleted, extending the continuous operating time of the vacuum cleaner assembly 100. Also, providing the second battery 106B onboard gives the user the ability to use both the upright vacuum cleaner 102 and the handheld accessory 104 without exchanging batteries 106, 106B. The second battery 106B may essentially be a duplicate of the battery 106 having the same battery characteristics. In some embodiments, the battery 106 has different characteristics than the second battery 106B. For example, but not limited to, the battery 106 may have a first battery capacity (e.g., 2 A-h), while the second battery 106B may have a second battery capacity (e.g., 4 A-h). The characteristics may further be any of, or any combination of, voltage, current, resistance, number of cells, etc.

Referring to FIG. 3, the handheld accessory 104 further includes a second airflow pathway 196 in some embodiments. When the handheld accessory 104 is coupled to the adapter 108, the second airflow pathway 196 is substantially blocked. The first airflow pathway 130 and the second airflow pathway 196 are separated and discrete from each other regardless of whether the handheld accessory 104 is coupled to the upright frame 112.

Figure 9:
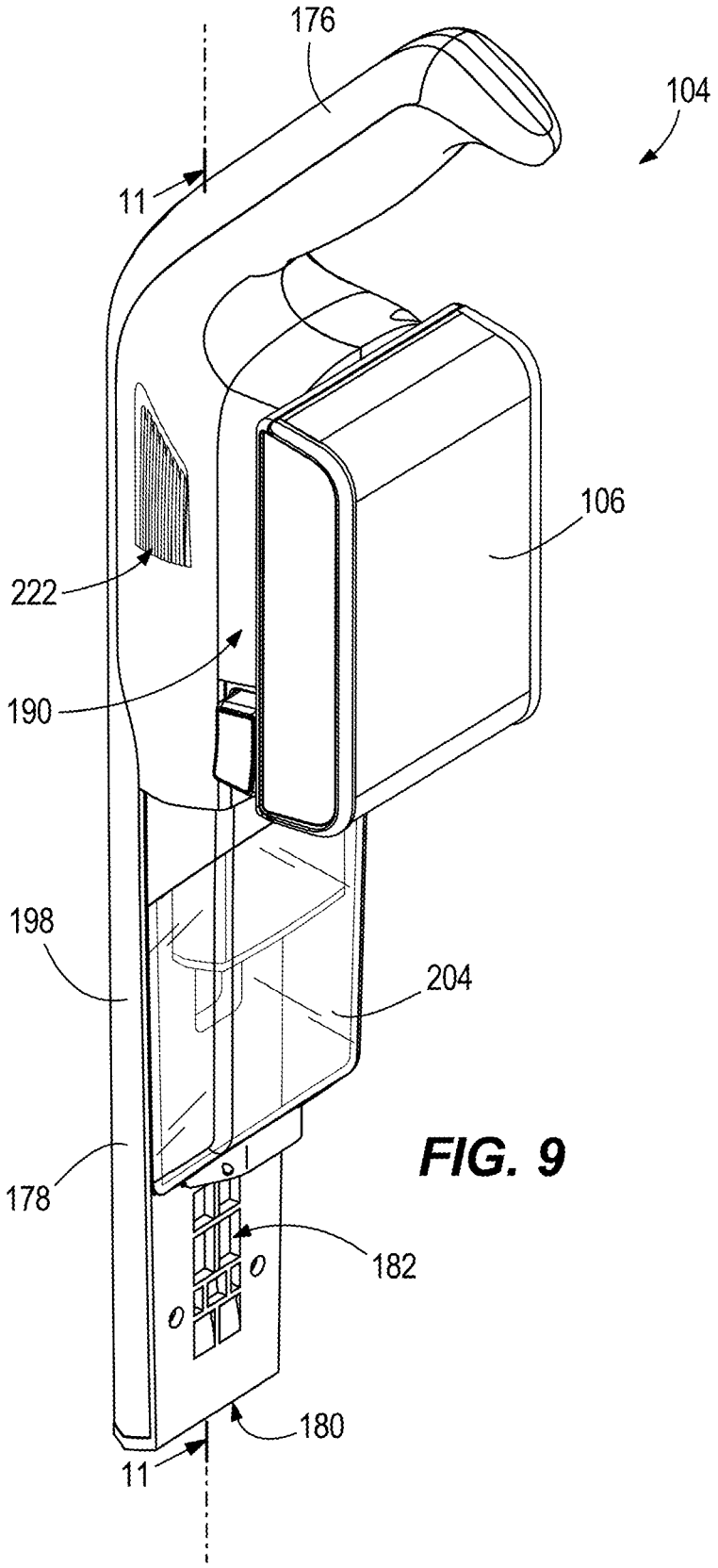
FIG. 9 illustrates a rear perspective view of the handheld accessory of the vacuum cleaner assembly of FIG. 1.

As shown in FIG. 9, the handheld accessory 104 functions as a stand-alone device when removed from the adapter 108 (and/or upright frame 112) and when fitted with the battery 106. In the illustrated embodiment, the handheld accessory 104 is a handheld vacuum, but other embodiments may include alternative accessories. Such alternative accessories include a powered scrub brush, wherein the operating component is a brush motor or other operating component; a powered upholstery or stair cleaning tool, wherein the operating component is a brush motor, suction motor, or other operating component; a powered cleaning solution sprayer, wherein the operating component is a pump, a valve, or other operating component; a drill, wherein the operating component is a drill motor or other operating component; a flashlight, wherein the operating component is a light or other operating component; or any other power tool and operating component.

Figure 10:
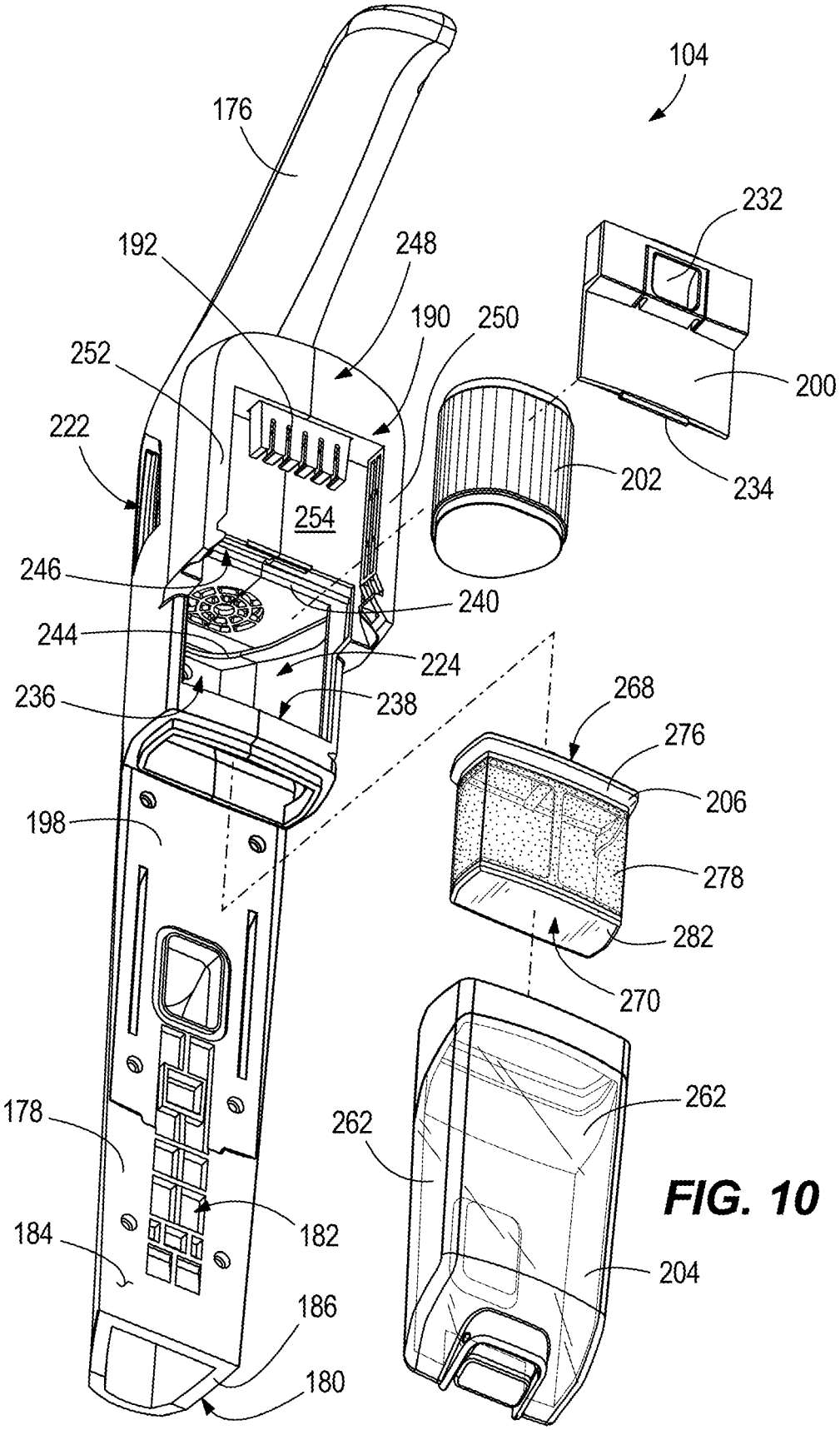
FIG. 10 illustrates an exploded rear perspective view of the handheld accessory of FIG. 9.
Figure 11:
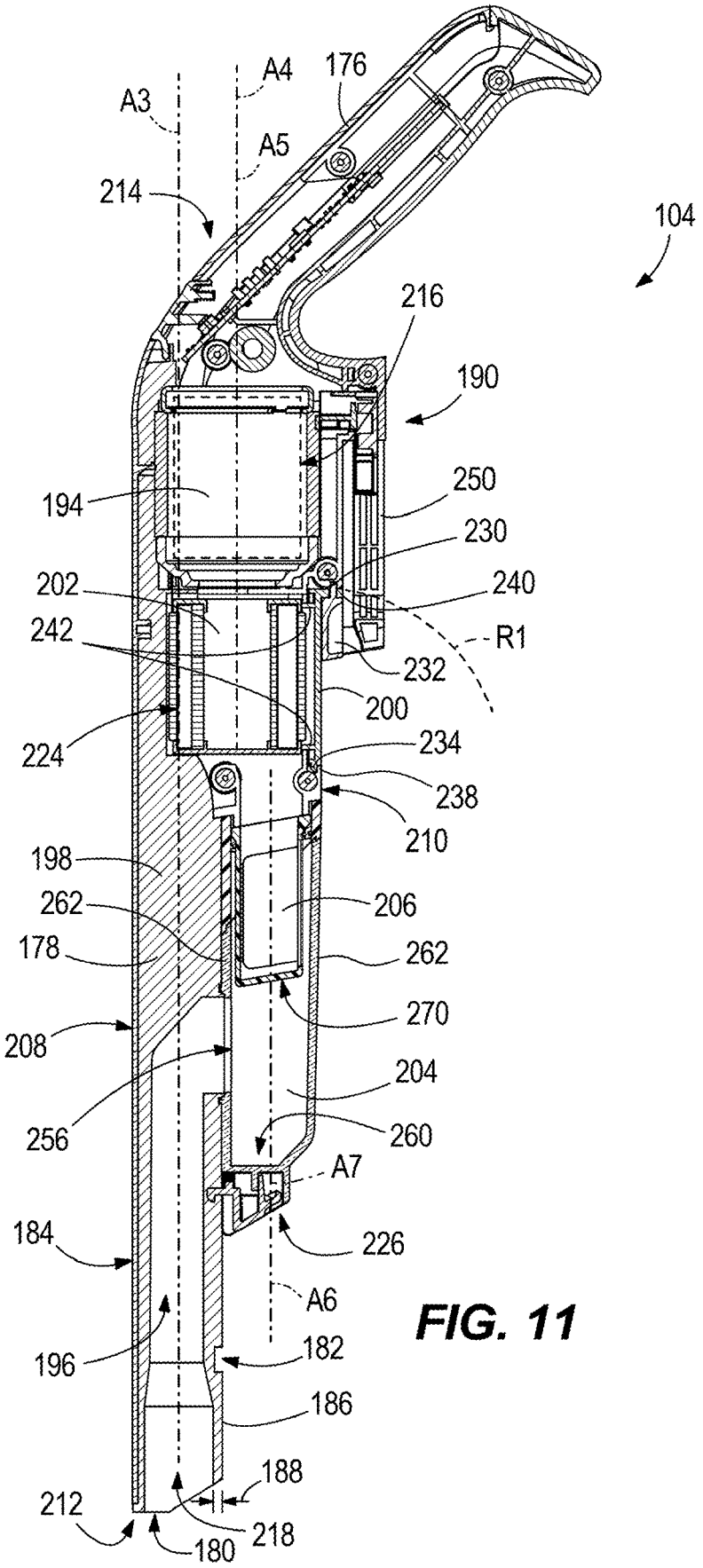
FIG. 11 illustrates a cross-sectional side view of the handheld accessory taken along line 11-11 of FIG. 9.

With reference to FIGS. 10 and 11, the handheld accessory 104 includes a housing 198, the motor (or second motor) 194, a filter access door 200, a filter 202, a dirt cup 204, and a shroud 206. The housing 198 includes a top 208, a bottom 210 opposite the top 208, a front 212, and a rear 214 opposite the front 212. The housing 198 further includes a motor chamber 216 defined therein, a dirty air inlet 218 defined by the nozzle end 180 at the front 212 of the housing 198, the handle 176 positioned at the rear 214 of the housing 198, a clean air outlet 222 defined therein, and the airflow pathway (or second airflow pathway) 196 fluidly connecting the dirty air inlet 218 with the clean air outlet 222.

As shown in FIG. 11, the motor 194 is disposed in the motor chamber 216 and defines a motor axis A4. The filter access door 200 is removably coupled to the housing 198 and cooperates with the housing 198 to define a filter chamber 224 (shown best in FIG. 10). The filter 202 is disposed in the filter chamber 224 and defines a filter axis A5. The dirt cup 204 is movably coupled to the housing 198 and defines a dirt cup axis A6 extending from a front 226 of the dirt cup 204 to a rear 228 of the dirt cup 204. The motor axis A4, the filter axis A5, and the dirt cup axis A6 extend parallel to each other, and generally extend along the longitudinal axis A3 of the elongate structural member 178. In some embodiments, the motor axis A4 and the filter axis A5 extend coaxially. In the illustrated embodiment, the shroud 206 includes a longitudinal axis A7 that extends parallel to the dirt cup axis A6.

As shown in FIG. 10, the filter access door 200 is located below the filter axis A5 such that the filter 202 is removable in a downward direction from the filter chamber 224 when the filter access door 200 is removed. In the illustrated embodiment, the filter access door 200 includes a latch 230 with a user actuation portion 232. Actuation of the user actuation portion 232 by a user causes the latch 230 to retract. In the illustrated embodiment, the latch 230 translates upon actuation of the user actuation portion 232. The filter access door 200 may further include a spring or another biasing member to bias the latch toward an extended position. The filter access door 200 further includes a catch 234 positioned opposite the latch 230.

The filter 202 is a cylindrical filter in the illustrated embodiment, in which air enters the filter radially from the peripheral surfaces into a central filter air path (FIG. 11) along the filter axis A5. The central filter air path is disposed in fluid communication with the motor chamber 216 through a filter chamber outlet (FIG. 10). The cylindrical filter 202 may be a pleated or non-pleated filter, and may be non-woven media, foam media, or other filter media, and in some embodiments may include combinations of two or more layers. In some embodiments, the filter 202 is a planar filter disposed in the filter chamber 224 in the airflow path 196 transverse to the motor axis A4.

As shown in FIG. 10, the housing 198 further includes a filter access opening 236 that is exposed upon removal of the filer access door 200. The housing 198 also includes a first ledge 238 adjacent the filter access opening 236 and a second ledge 240 adjacent the filter access opening 236 on an opposite side of the filter access opening 236 from the first ledge 238. The catch 234 engages the first ledge 238 of the housing 198. The latch 230 engages the second ledge 240 of the housing 198. To remove the filter access door 200, the user retracts the latch 230 and swings the filter access door 200 about at least a portion of the catch 234. As such, the latch 230 travels along an arc R1.

In the illustrated embodiment, the filter access door 200 further includes at least one door filter support 242. The housing 198 also includes at least one corresponding housing filter support 244. The door filter support 242 and the housing filter support 244 are located in the filter chamber 224 when the filter access door 200 is coupled to the housing 198. One or both of the door filter support 242 and the housing filter support 244 are provided to orient the filter 202, and may be configured to hold the filter 202, in position within the filter chamber 224. In the illustrated embodiment, the filter 202 is located directly upstream of the motor 194 (and a corresponding fan/impeller) when the filter 202 is in position.

Also shown in FIG. 11, the second airflow pathway 196 enters the dirty air inlet 218, which is located in the nozzle end 180 in some embodiments, travels through the elongate structural member 178 in a direction generally parallel to the longitudinal axis A3 of the elongate structural member, turns and enters the dirt collection chamber 260 of the dirt cup 204 via the dirt cup inlet 256, passes through the mesh screen 278 (FIG. 12) of the shroud 206, exits the dirt cup 204 via the dirt cup outlet 258 (FIG. 12), enters the filter chamber 224, passes through the filter 202, enters the motor chamber 216, and exits the clean air outlet 222 (FIGS. 9 and 10) defined in the housing 198.

As shown in FIGS. 2 and 10, the housing 198 further includes the second battery mount (or battery mount) 190. In the illustrated embodiment, the battery mount 190 is disposed below the motor 194. At least a portion of the battery mount 190 is also located on an opposite side of the filter access door 200 from the filter 202. In an alternative embodiment, the battery mount 190 is positioned on the top 208 disposed above the motor 194. Stated another way, in some embodiments at least a portion of the battery mount 190 is not located on an opposite side of the filter access door 200 from the filter 202.

The battery mount 190 includes an open end 246, a closed end 248 opposite the open end 246, and at least one battery connection terminal (second battery connection terminal) 192. The at least one battery connection terminal 192 is positioned nearer the closed end 248 than the open end 246. In the illustrated embodiment, the battery mount 190 further includes a first rail 250 and a second rail 252 extending generally parallel to each other. The first rail 250 and the second rail 252 extend between the open end 246 and the closed end 248. The rails 250, 252 function to slidably guide the battery 106 into engagement with the at least one battery connection terminal 192. The arrangement of the rails 250, 252 creates a recessed face 254 of the battery mount 190 disposed therebetween.

As shown in FIGS. 2 and 11, at least a portion of the filter access door 200 is adjacent the battery mount 190. In the illustrated embodiment, at least a portion of the filter access door 200 is substantially flush with the recessed face 254 of the battery mount 190. The filter access door 200 is shown as a stepped door, but may be a plate that is substantially planar or other desired shape. In the illustrated embodiment, the portion of the filter access door 200 that is substantially flush with the recessed face 254 is also positioned adjacent the open end 246 of the battery mount 190. Specifically, in some embodiments, the user actuation portion 232 of the latch 230 is positioned adjacent the open end 246 of the battery mount 190 and extends toward the closed end 248 of the battery mount 190. In this arrangement, the latch 230 is disposed nearer the battery mount 190 than the catch 234 is. At least a portion of the first rail 250 is disposed on an opposite lateral side of the user actuation portion 232 from at least a portion of the second rail 252. Stated another way, the user actuation portion 232 may be at least partially disposed between portions of the first and second rails 250, 252. As such, the arc R1 along which the latch 230 travels upon installation or removal of the filter access door 200 is at least partially surrounded by the battery mount 190. Stated another way, installation or removal of the filter access door 200 is blocked by the battery 106 when the battery 106 is received within the battery mount 190.

The battery 106 is removably coupled to the battery mount 190 of the housing 198. In the illustrated embodiment, when the battery 106 is coupled to the battery mount 190, the battery 106 at least partially covers the filter access door 200. Stated another way, the battery 106 may cover at least a portion of the filter access door 200 when the battery 106 is received within the battery mount 190. In the illustrated embodiment, the user actuation portion 232 of the latch 230 is covered by the battery 106 when the battery 106 is coupled to the battery mount 190. In some embodiments, the battery 106 covers at least a portion of the user actuation portion 232 of the latch 230 inhibiting access to the user actuation portion 232 when the battery 106 is received within the battery mount 190. In order to remove the filter 202 from the illustrated filter chamber 224, the user must first remove the battery 106 from the battery mount 190. Once the battery 106 is removed, the user may access and remove the filter access door 200 from the housing 198. Only once the filter access door 200 has been removed can the user remove the filter 202 from the filter chamber 224.

As shown in FIG. 10, the handheld accessory 104 includes the dirt cup 204 movably coupled to the housing 198. In the illustrated embodiment, the dirt cup 204 is removably coupled to the housing 198, but other embodiments include the dirt cup 204 pivotally or translatably coupled to the housing 198 without being removable from the housing 198.

Figure 12:
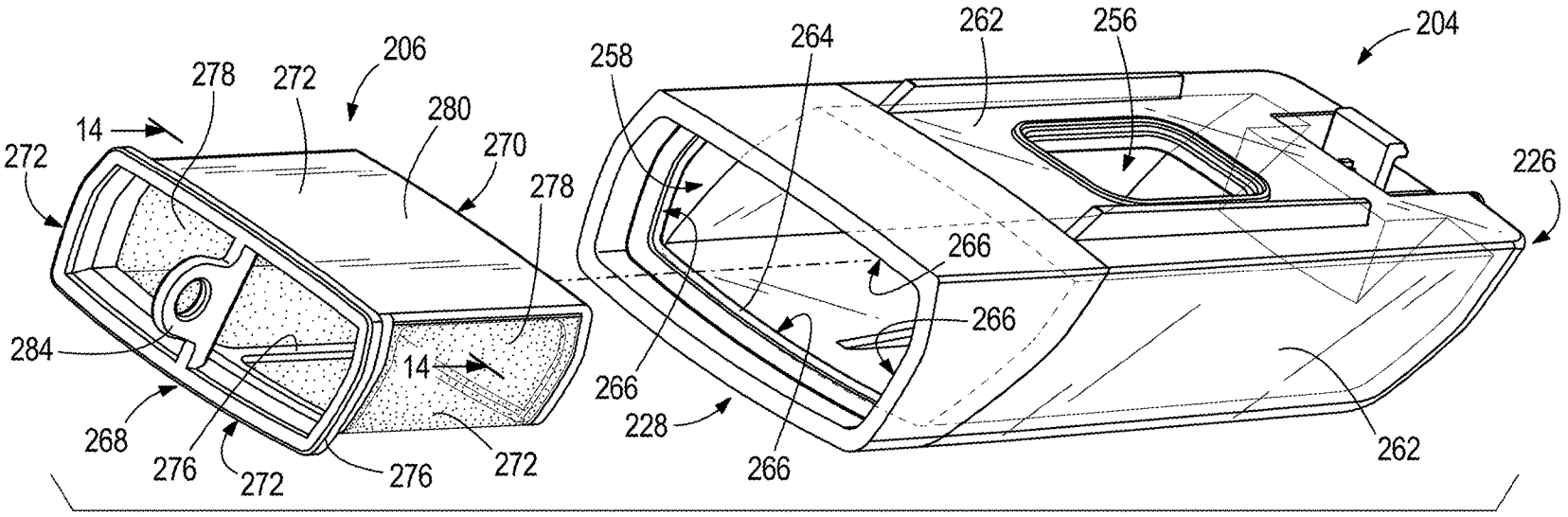
FIG. 12 illustrates a perspective view of the dirt cup of the handheld accessory of FIG. 1 with the shroud exploded therefrom.

With reference to FIG. 12, the dirt cup 204 includes a dirt cup inlet 256, a dirt cup outlet (or dirt cup opening or dirt cup exhaust opening) 258, and a dirt collection chamber 260 defined at least partially between the dirt cup inlet 256 and the dirt cup outlet 258. As shown in FIG. 11, the dirt cup outlet 258 is positioned adjacent to and facing the filter chamber 224. Returning to FIG. 12, although the dirt cup 204 could be cylindrical or another shape, the illustrated embodiment includes the dirt cup 204 having a plurality of dirt cup sidewalls 262.

Figure 13:
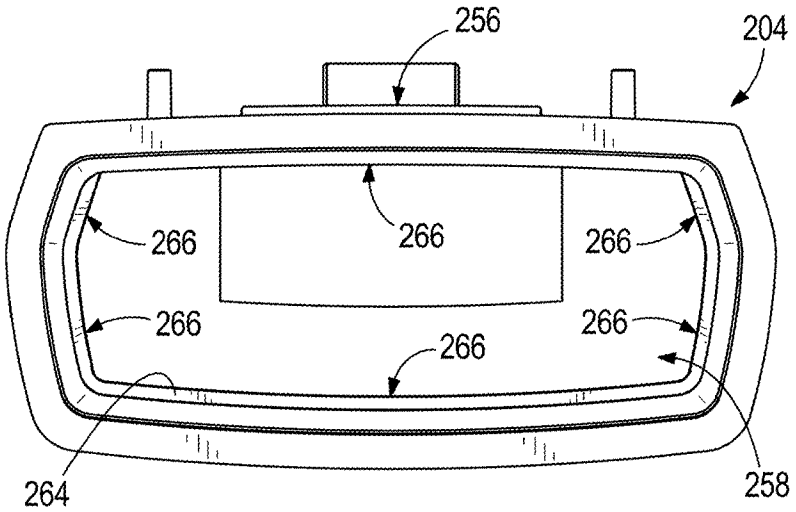
FIG. 13 illustrates a rear elevation view of the dirt cup of FIG. 12.

As shown in FIG. 13, the handheld accessory 104 also includes at least one wipe member 264 disposed about the dirt cup opening 258. The wipe member 264 extends inwardly to reduce the size of the dirt cup opening 258, such that the wipe member 264 extends adjacent to or in contact with lateral sides of the shroud 206 as the shroud 206 is removed from the dirt cup opening 258 inhibiting debris from being removed with the shroud 206. The wipe member 264 is flexible relative to the dirt cup 204, such as an elastomeric wiper or an array of bristles. In the illustrated embodiment, the wipe member 264 is a polymer that is overmolded onto the dirt cup 204. Although the dirt cup opening 258 could be circular, elliptical, or another shape, the illustrated embodiment includes the dirt cup opening 258 having a plurality of opening sides 266. In this embodiment, the wipe member 264 is disposed on fewer than all of the plurality of opening sides 266. Specifically, the wipe member 264 is a continuous body that is disposed on all of the plurality of opening sides 266 except one, as further described below.

Referring to FIG. 12, the handheld accessory 104 also includes the shroud 206. The shroud 206 includes a first end 268 and a second end 270 opposite the first end 268. The second end 270 is spaced farther from the dirt cup outlet 258 than the first end 268 is. Although the shroud 206 could be cylindrical or another shape, the illustrated embodiment includes the shroud 206 has plurality of shroud lateral sides 272 extending between the first and second ends 268, 270 of the shroud 206. Specifically, the shroud 206 is shown as being a generally hexagonal prism. Other embodiments could include, for instance, a shroud 206 being a generally rectangular prism or a cylinder. Although the second end 270 of the shroud 206 could be rounded or pointed, the illustrated embodiment includes the shroud 206 having a shroud end facet at the second end 270.

Figure 14:
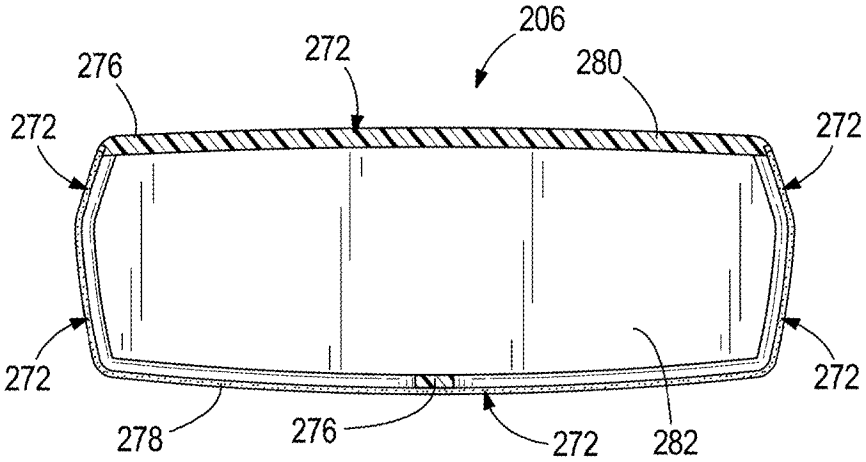
FIG. 14 illustrates a cross-sectional view of the shroud taken along line 14-14 of FIG. 12.

The shroud 206 further includes a shroud frame 276 supporting a mesh screen 278 coupled thereto. As shown in FIG. 14, the shroud frame 276 and the mesh screen 278 cooperate to give the shroud 206 its shape and to define a lateral outer perimeter of the shroud 206. In the illustrated embodiment, at least one of the shroud lateral sides 272 is at least partially closed to airflow therethrough while the other shroud lateral sides 272 are permeable to airflow therethrough, forming an air path from inside of the dirt cup 204 into the shroud 206. The mesh screen 278 allows the shroud 206 to at least partially filter debris from the airflow that passes from the dirt cup inlet 256 to the dirt cup outlet 258. Particles that might clog or damage the filter 202 are, therefore, prevented from reaching the filter 202. The mesh screen 278 is selected with a mesh size as desired for operation with the selected filter 202. In some embodiments the mesh size is between about 100 micron and 1 mm, and more particularly between about 200 micron and 500 micron. The mesh screen 278 may be woven or non-woven media, wire mesh, perforated media, etched media, or other mesh media as desired.

With reference to FIG. 12, the shroud lateral side 272 that is at least partially closed to airflow therethrough is illustrated as being entirely closed to airflow therethrough. Specifically, the shroud 206 includes a shroud lateral sidewall 280 that forms the entirety of one of the shroud lateral sides 272. The shroud lateral sidewall 280 blocks the airflow from passing through the shroud lateral side 272 such that the shroud lateral side 272 is entirely closed to airflow therethrough. Other embodiments include the shroud lateral sidewall 280 blocking only a portion of the shroud lateral side 272. In yet another embodiment, all of the shroud lateral sides 272 are permeable to airflow therethrough, such as including the mesh screen 278 on at least a portion of each lateral side 272 forming an air path from inside of the dirt cup 204 into the shroud 206. In the illustrated embodiment, the shroud lateral sidewall 280 is integrally formed as a unitary part with the shroud frame 276.

The second end 270 is closed to airflow therethrough in the illustrated embodiment. In some embodiments, the second end 270 includes a shroud endwall 282 that blocks airflow through at least a portion of the second end 270. In the illustrated embodiment, the shroud endwall 282 blocks airflow through the entirety of the second end 270. The shroud endwall 282 is integrally formed as a unitary part with the shroud frame 276. In other embodiments, the second end 270 is permeable to airflow therethrough, such as including the mesh screen 278 on at least a portion of the second end 270.

The shroud 206 is coupled to the dirt cup 204 in the illustrated embodiment and extends at least partially through the dirt cup opening 258 and into the dirt collection chamber 260. As such, at least a portion of the shroud 206 is disposed between the dirt cup inlet 256 and the dirt cup outlet 258, such that the mesh screen 278 is provided in the air path between dirt cup inlet 256 and the dirt cup outlet 258.

The shroud 206 may include a pull tab 284 or other handle such that the shroud 206 may more easily be removed from the dirt cup 204. In the illustrated embodiment, the pull tab 284 is integrally formed as a unitary part with the shroud frame 276. This pull tab 284 is arranged on the first end 268 of the shroud 206, which may be considered an open shroud attachment end.

As shown in FIG. 11, the shroud 206 is positioned nearer one of the dirt cup sidewalls 262 than another of the dirt cup sidewalls 262 such that the shroud 206 is off-center with respect to the dirt cup 204 in cross-section. In the illustrated embodiment, the shroud lateral sidewall 280 is closed to airflow, inhibiting collection of debris in the reduced space between the shroud 206 and the dirt cup sidewall 262 adjacent the shroud lateral sidewall 280. In some embodiments, the at least one of the shroud lateral sides 272 that has at least a portion closed to airflow therethrough is blocked due to its proximity to the nearest dirt cup sidewall 262. Stated another way, a shroud lateral side 272 is at least partially blocked by a corresponding dirt cup sidewall 262 such that airflow cannot pass through at least a portion of the respective shroud lateral side 272. In some embodiments, the respective shroud lateral side 272 of the shroud 206 is removably coupled to the corresponding dirt cup sidewall 262.

With reference to FIGS. 12 and 13, the wipe member 264 of the dirt cup 204 wipes the shroud 206 upon removal of the shroud 206 from the dirt cup 204. In some instances, the wipe member 264 wipes debris/dirt from the shroud 206 upon removal of the shroud 206 and keeps the debris/dirt in the dirt collection chamber 260. In the illustrated embodiment, the wipe member 264 is disposed on all of the plurality of opening sides 266 of the dirt cup opening 258 except for the opening side 266 corresponding to the shroud lateral sidewall 280. In this manner, the wipe member 264 is not needlessly worn due to wiping a shroud lateral side 272 that does not require wiping. In some embodiments, all of the shroud lateral sides 272 are air permeable and the wipe member 264 extends around all of the corresponding opening sides 266.

As shown in FIG. 14, the shroud frame 276, which is integrally formed as a unitary part with the shroud lateral sidewall 280 in the illustrated embodiment, blocks airflow from passing through a continuous section of at least twenty-five percent (25%) of the lateral outer perimeter of the shroud 206 in cross-section. In some embodiments, this continuous section is greater than twenty-five percent (25%) and less than fifty percent (50%). In some embodiments, the continuous section blocking airflow with the shroud lateral sidewall 280 is greater than 5% and less than 25% of the lateral outer perimeter of the shroud 206 in cross-section. The cross-section in FIG. 14 is taken through a plane that is perpendicular to the longest dimension of the shroud 206. Stated another way, the cross-section in FIG. 14 is taken through a plane that is perpendicular to the longitudinal axis A7 of the shroud 206.

Although the present disclosure has been discussed with regard to an upright vacuum cleaner 102 and a handheld accessory 104 in the form of a handheld vacuum cleaner, this disclosure contemplates combinations of other components. For instance, the upright cleaner 102 can be a floor cleaner including a cleaning solution tank, fluid dispensing nozzles, and scrubbing members for carpet cleaning or the like. The handheld accessory 104 can be a handheld fluid dispensing device including a dispensing nozzle to spray cleaning solution for spot treatment cleaning or the like. The handheld accessory 104 can be a handheld powered upholstery or stair cleaning tool, including an motor driven agitator or brush, or other powered cleaning implement.

Figure 15:
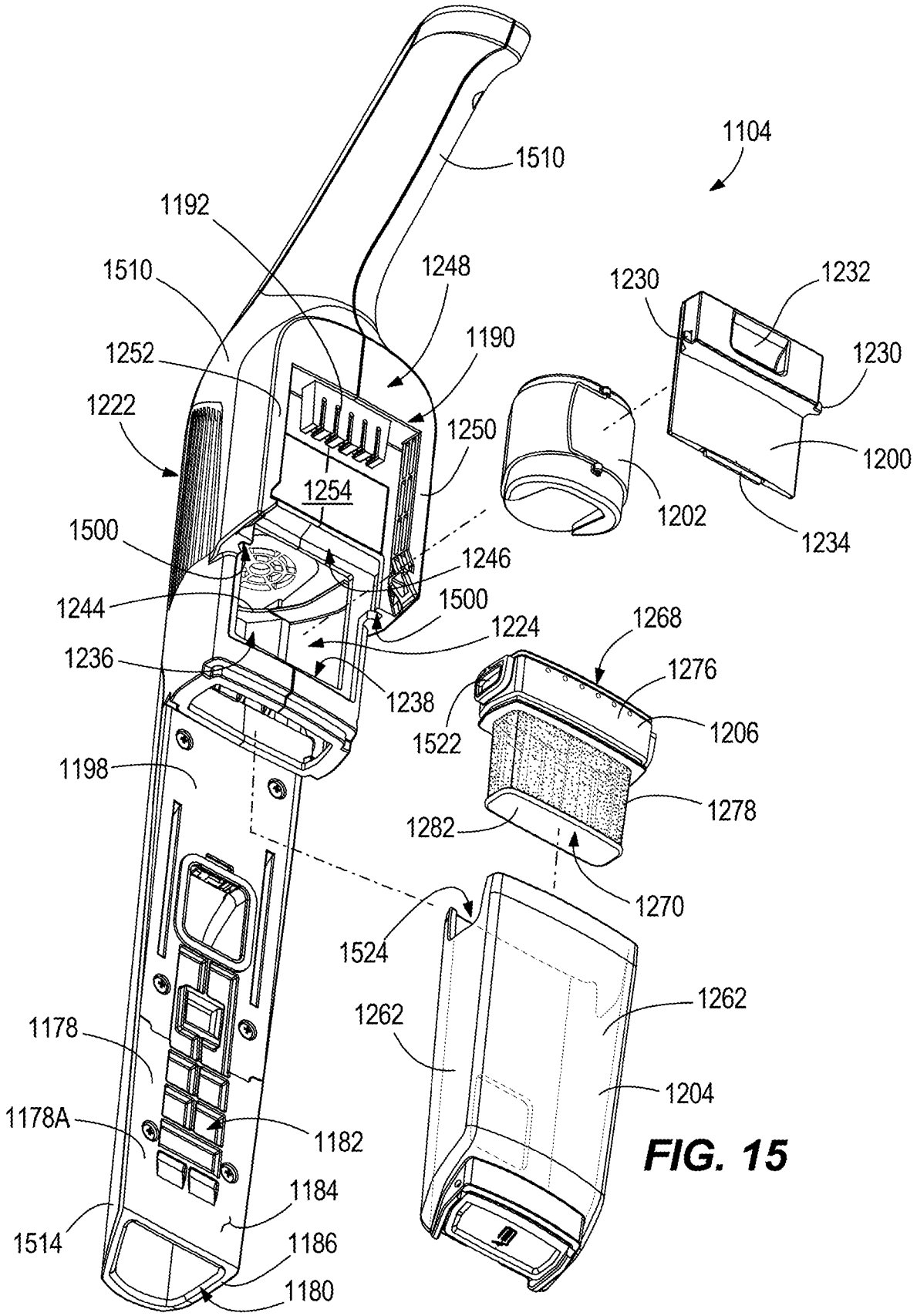
FIG. 15 illustrates an exploded rear perspective view of another embodiment of a handheld accessory of the vacuum cleaner assembly of FIG. 1.

With reference to FIG. 15, another embodiment of a handheld accessory 1104 is shown. The handheld accessory 1104 is similar in many ways to the handheld accessory 104 shown in FIG. 10. As such, only differences between the handheld accessories 104, 1104 will be discussed herein with regard to the handheld accessory 1104 shown in FIG. 15. The similar features between the handheld accessories 104, 1104 have the same number, only increased by a value of one thousand for the handheld accessory 1104 shown in FIG. 15.

The handheld accessory 1104 includes a filter access door 1200 that can be removed to access the filter 1202. The filter access door 1200 includes a user actuation portion 1232, which actuates two opposing latches 1230. In the illustrated embodiment, the latches 1230 extend laterally outwardly in opposing directions. Actuation of the user actuation portion 1232 causes the latches 1230 to retract along the length of the filter access door 1200. A spring or another biasing member may resist retraction of the latches 1230. The filter access door 1200 further includes a catch 1234 positioned generally opposite the user actuation portion 1232. In the illustrated embodiment, the catch 1234 extends outwardly in a direction that is perpendicular to a plane containing the laterally outward directions in which the latches 1230 extend.

Also shown in FIG. 15, the housing 1198 includes a filter access opening 1236 that is exposed upon removal of the filter access door 1200. The housing 1198 includes a ledge 1238 adjacent the filter access opening 1236. The housing 1198 also includes two opposing channels 1500 defined therein generally opposite the ledge 1238.

Figure 16:
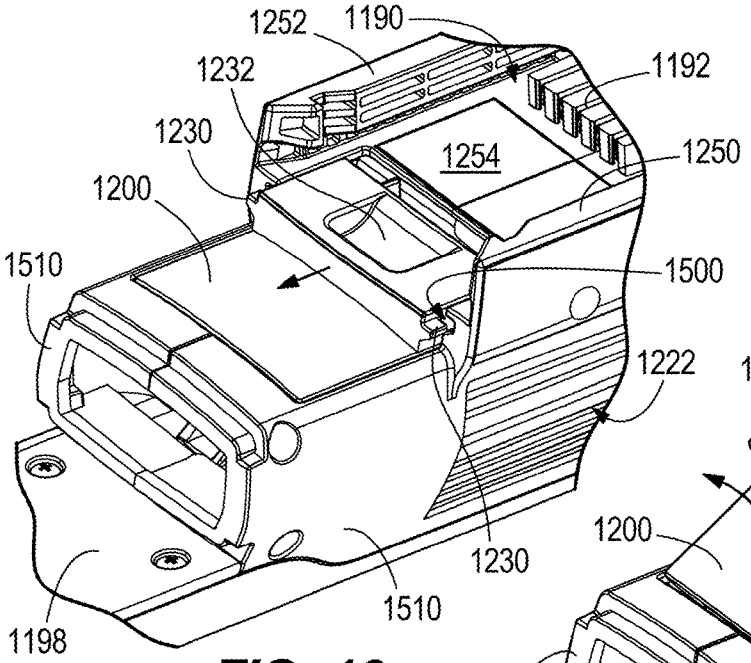
FIG. 16 illustrates a detailed perspective view of the filter access door in a closed position with the latch disengaged from the housing of the handheld accessory of FIG. 15.
Figure 17:
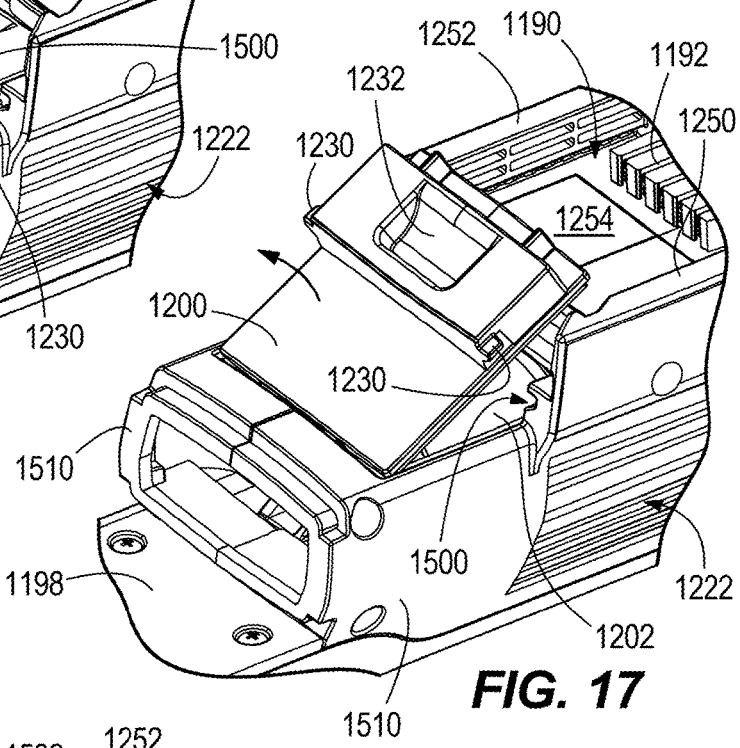
FIG. 17 illustrates the detailed perspective view of FIG. 16 with the filter access door partially removed from the housing.
Figure 18:
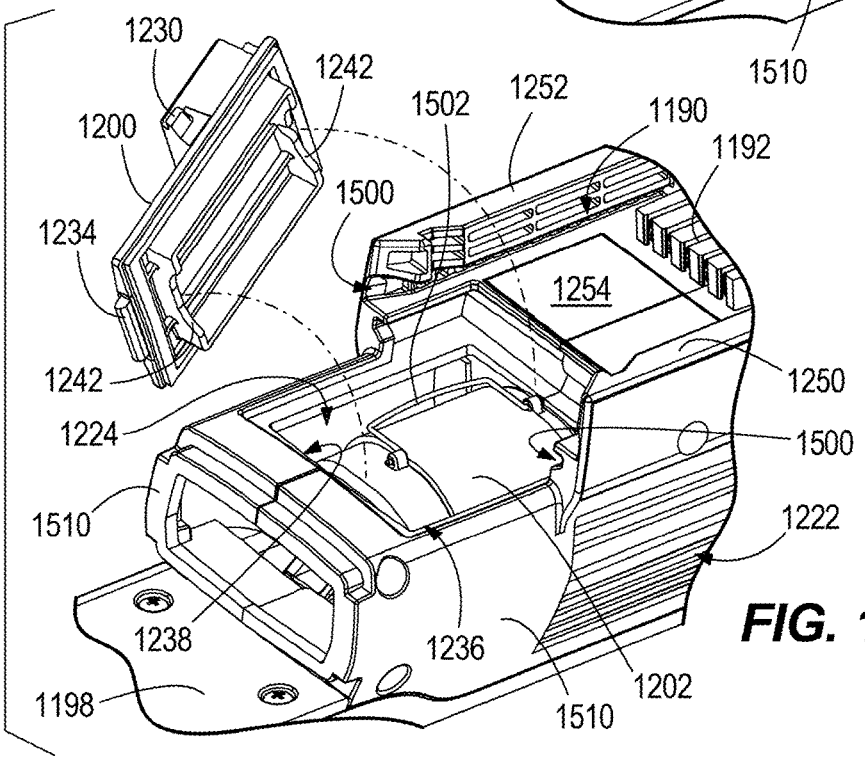
FIG. 18 illustrates the detailed perspective view of FIG. 16 with the filter access door completely removed from the housing.

Referring to FIGS. 16-18, removal of the filter access door 1200 from the housing 1198 is illustrated. The catch 1234 engages the ledge 1238 and each of the latches 1230 engages the corresponding channel 1500 while the filter access door 1200 is on the housing 1198. A user removes the filter access door 1200 by retracting the latches 1230 through actuation of the user actuation portion 1232 (FIG. 16). The user may next swing the filter access door 1200 open by pivoting the filter access door 1200 about the contacting interface between the catch 1234 of the filter access door 1200 and the ledge 1238 of the housing 1198 (FIG. 17). This pivoting causes each of the latches 1230 to travel along an arc R2 (shown in FIG. 21). Once the filter access door 1200 has been swung open a sufficient distance, the user may fully remove the filter access door 1200 by pulling the catch 1234 of the filter access door 1200 out of engagement with the ledge 1238 of the housing 1198 (FIG. 18).

Figure 19:
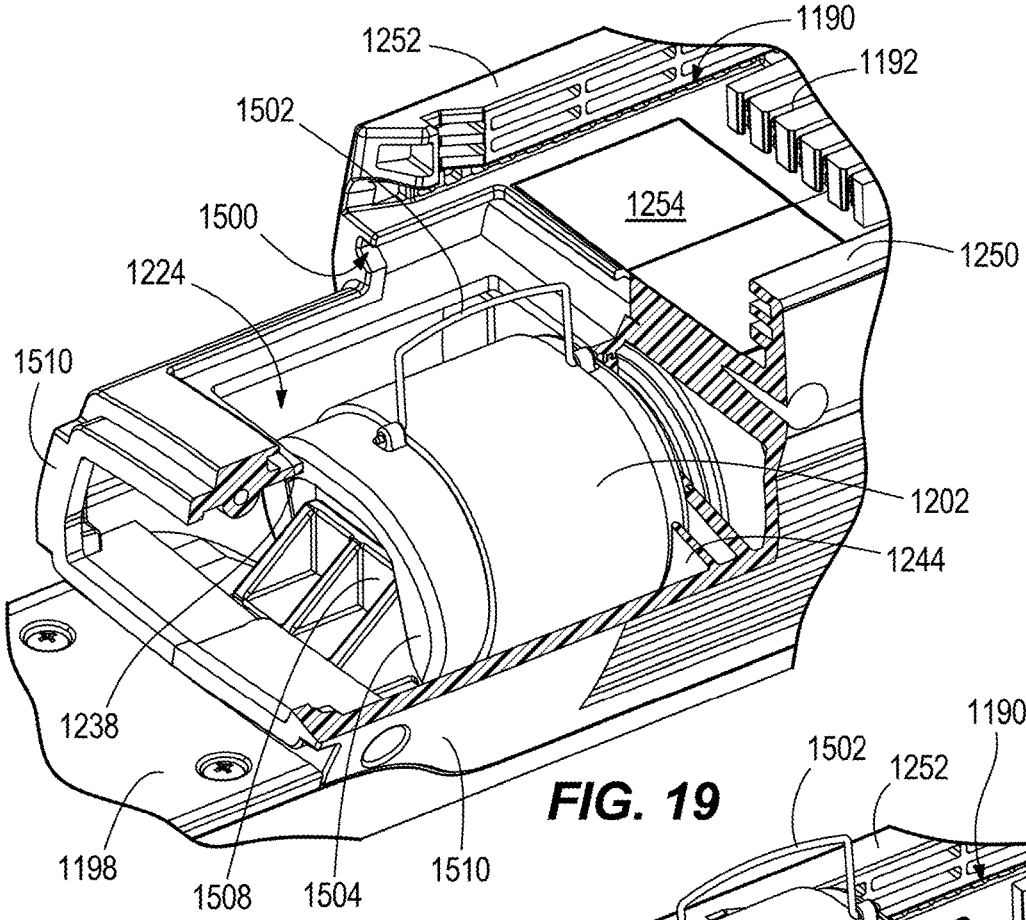
FIG. 19 illustrates a detailed and partially sectioned perspective view of the handheld accessory of FIG. 15 with the filter access door removed.

As shown in FIG. 19, with the filter access door 1200 removed, the user may next remove the filter 1202 from the filter chamber 1224. In the illustrated embodiment, the filter 1202 includes a handle 1502 for a user to grasp to more easily remove the filter 1202 from the filter chamber 1224. In some embodiments, the handle 1502 is pivotable relative to the body of the filter 1202 in order to more easily store the handle 1502 in the filter chamber 1224. The handle 1502 pivots from a storage position (FIG. 18) to a deployed position (FIG. 19). In some embodiments, the handle 1502 may be biased toward one of the storage position and the deployed position.

Figure 20:
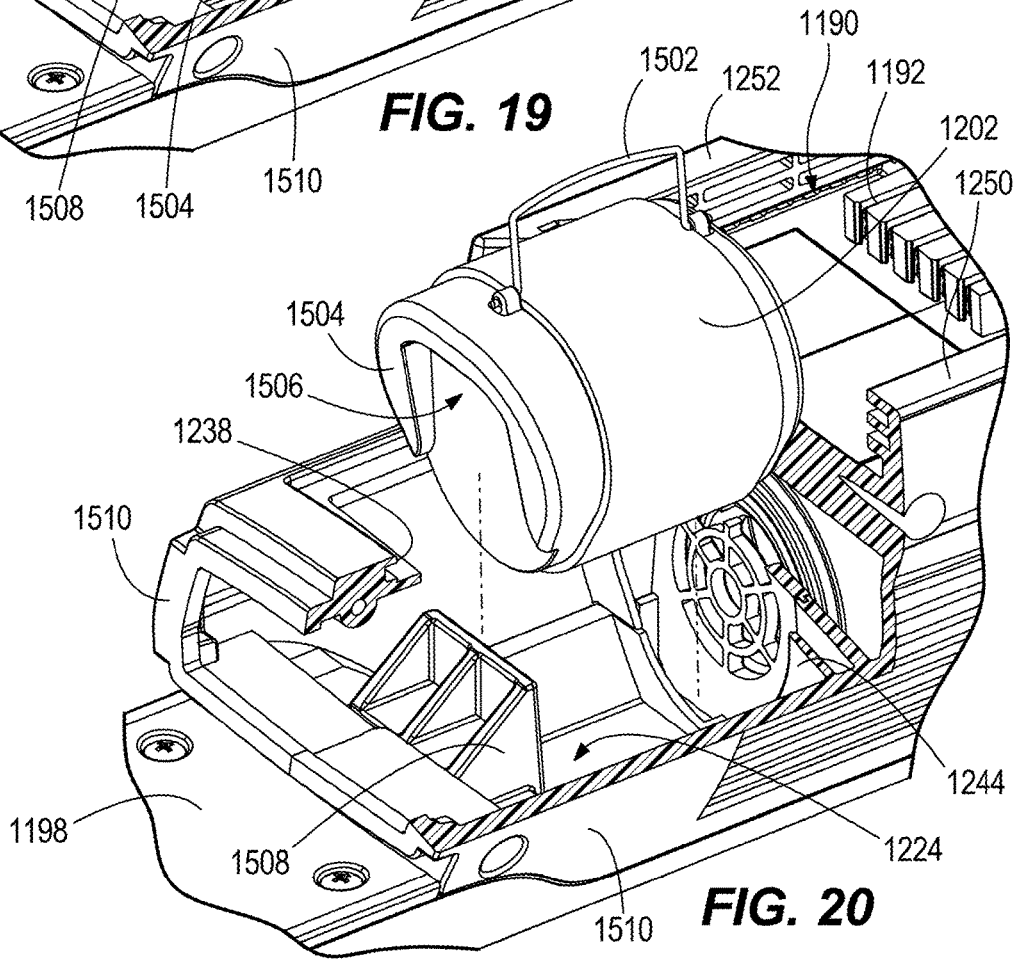
FIG. 20 illustrates the detailed and partially sectioned perspective view of FIG. 19 with the filter removed from the housing.

With reference to FIGS. 19 and 20, the filter 1202 further includes an angled surface 1504 having a block receiving recess 1506 defined therein. The handheld accessory 1104 further includes a corresponding block, or rail, 1508 that projects into the filter chamber 1224 and is received in the block receiving recess 1506 to assist in maintaining the filter 1202 in place in the filter chamber 1224. In the illustrated embodiment, the angled surface 1504 of the filter 1202 at least partially surrounds the block 1508. This interface between the block 1508 and the block receiving recess 1506 locates the filter 1202 at least one of laterally and rotationally relative to the housing 1198. Some embodiments further include the filter access door 1200 having one or more door filter supports 1242 and/or the housing 1198 having one or more housing filter supports 1244.

Figure 21:
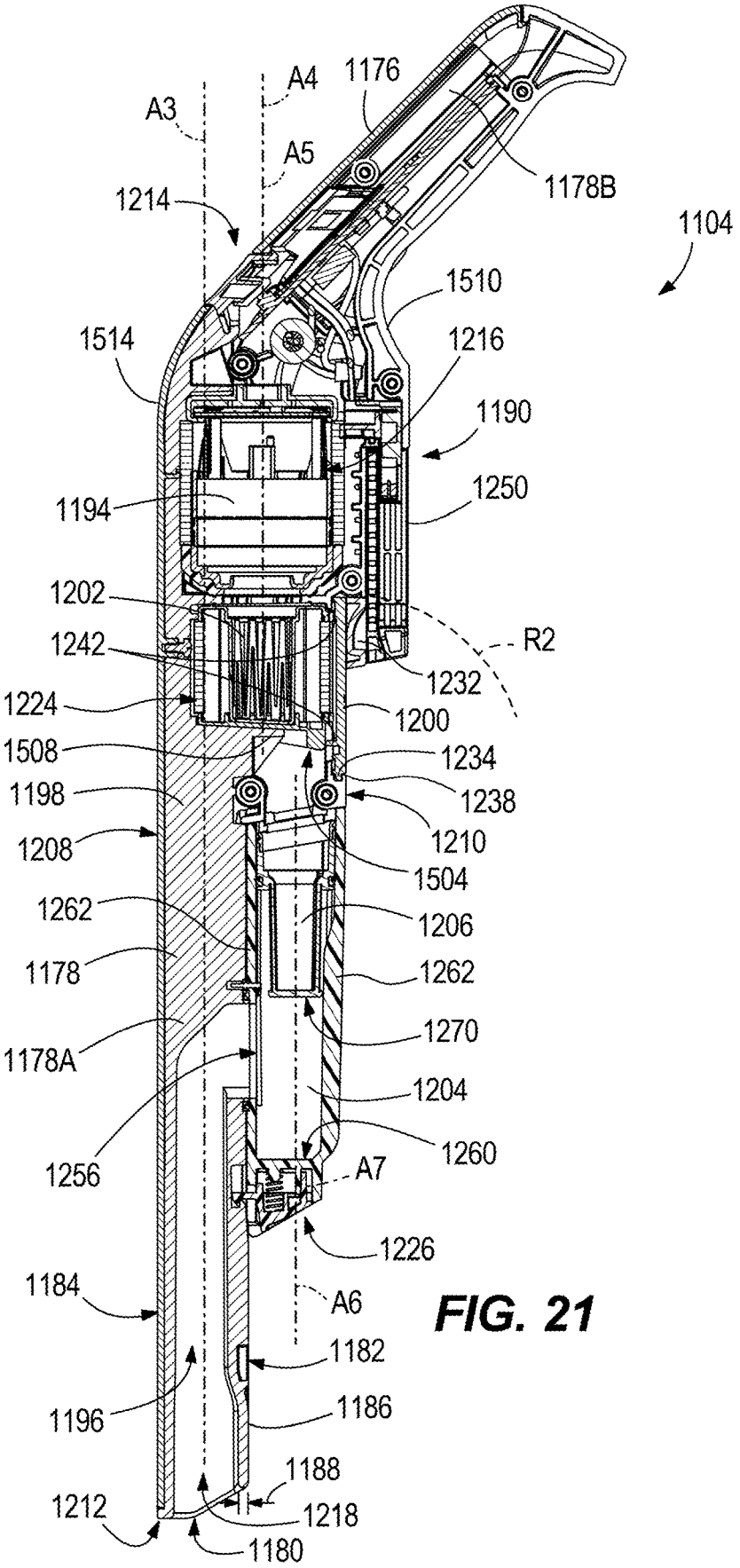
FIG. 21 illustrates a cross-sectional side view of the handheld accessory of FIG. 15.
Figure 22:
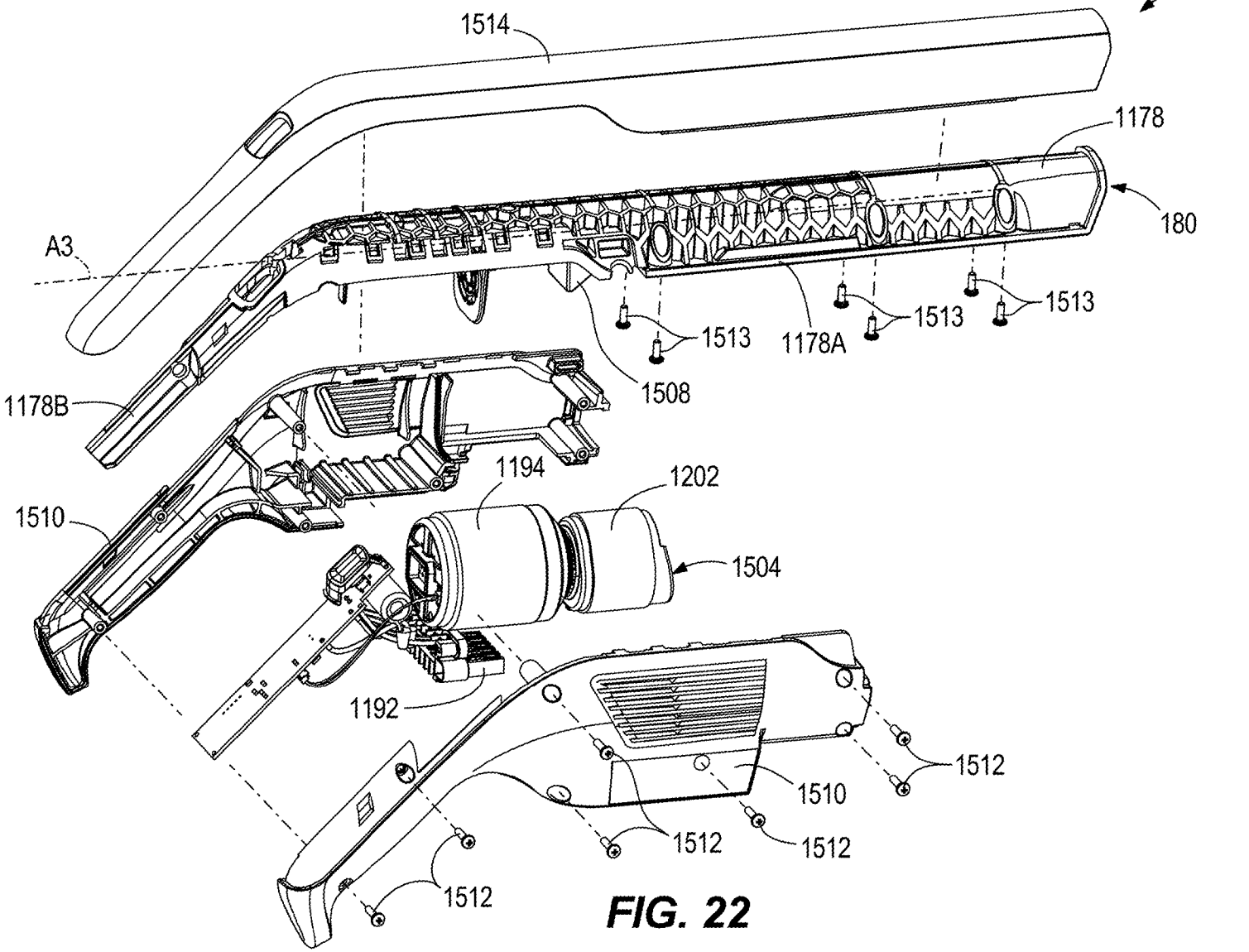
FIG. 22 illustrates an exploded side perspective view of the handheld accessory of FIG. 15.

As shown in FIGS. 21 and 22, the block 1508 is illustrated as being a single unitary piece with an elongate structural member 1178. In such embodiments, the block 1508 may be less susceptible to breaking due to improper installation or removal of the filter 1202. In some embodiments, the elongate structural member 1178 is made of a more durable material than other components of the handheld accessory 1104. The elongate structural member 1178 made of metal or rigid nylon and the housing 1198 made of a less rigid plastic. Other material choices are also contemplated herein.

As shown in FIG. 22, the housing 1198 may be made of multiple separate components. These components of the housing 1198 surround and are fastened to the elongate structural member 1178 to form a box beam shape. In the illustrated embodiment, two side panel sections 1510 surround the tang portion 1178B and at least some of the body portion 1178A of the elongate structural member 1178. Fasteners 1512 couple the side panel sections 1510 of the housing 1198 to the elongate structural member 1178. The fasteners 1512 extend in a direction that is perpendicular to a plane containing the longitudinal axis A3 of the elongate structural member 1178, the dirt cup axis A6, and the tang portion 1178B in order to add rigidity to the handheld accessory 1104. In the illustrated embodiment, the housing 1198 further includes a longitudinal section 1514. As discussed above, fasteners 1513 also couple the longitudinal section 1514 of the housing 1198 to the elongate structural member 1178. Once more, the fasteners 1513 extend in a direction that is perpendicular to a plane containing the longitudinal axis A3 of the elongate structural member 1178, albeit a different plane in this instance.

Figure 23:
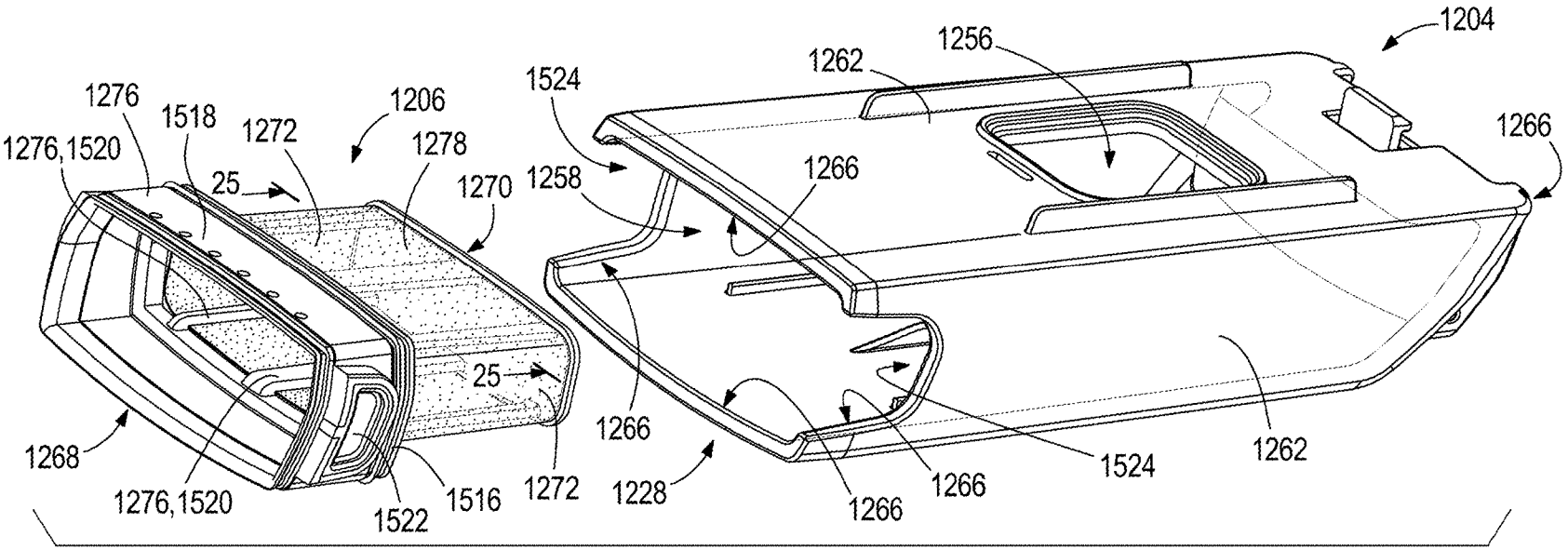
FIG. 23 illustrates a perspective view of the dirt cup of the handheld accessory of FIG. 15 with the shroud exploded therefrom.
Figure 24:
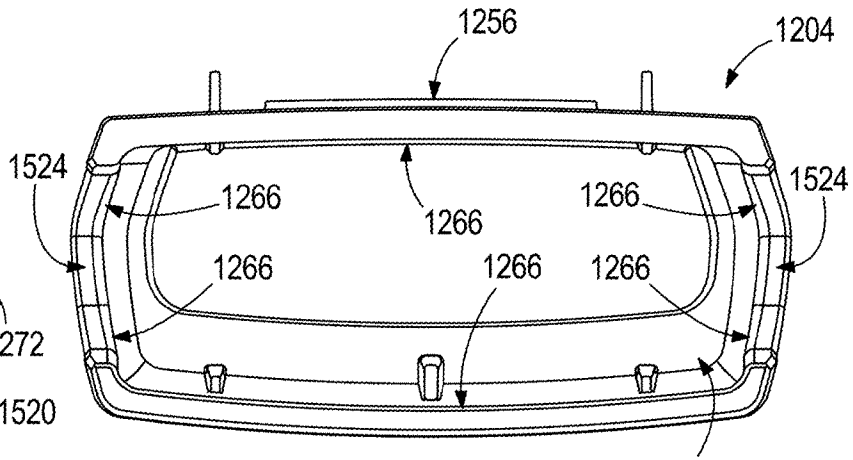
FIG. 24 illustrates a rear elevation view of the dirt cup of FIG. 23.
Figure 25:
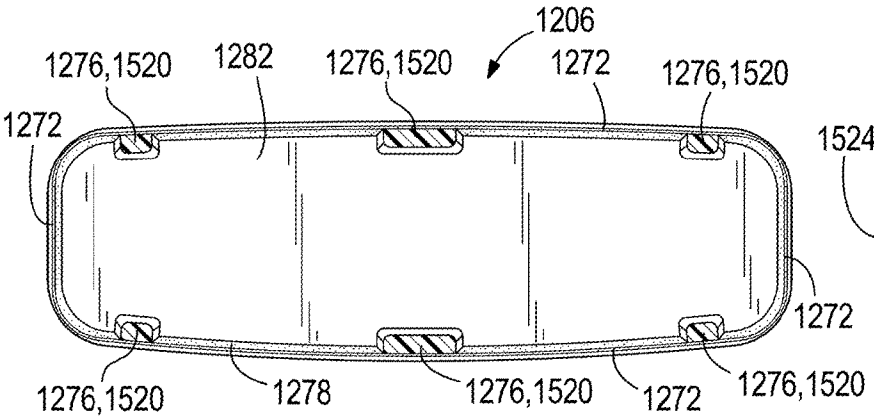
FIG. 25 illustrates a cross-sectional view of the shroud taken along line 25-25 of FIG. 23.

With reference to FIGS. 23-25, the handheld accessory 1104 has a dirt cup 1204 with no wipe members. The shroud 1206 includes a seal member 1516 around the periphery of the shroud 1206 for sealing engagement with the dirt cup 1204. The shroud 1206 further includes a shroud endwall 1282 coupled to a shroud collar 1518 via a plurality of shroud ribs 1520. In the illustrated embodiment, the shroud endwall 1282, the shroud collar 1518, and the shroud ribs 1520 are formed together as a unitary part to make up the shroud frame 1276. The shroud 1206 further includes two laterally opposed grips 1522 for a user to engage in order to pull the shroud 1206 from the dirt cup 1204. In the illustrated embodiment, the grips 1522 are formed as a unitary part with the rest of the shroud frame 1276. The dirt cup 1204 also includes grip indentations 1524 to receive the grips 1522 of the shroud 1206.

Various features and advantages of the disclosure are set forth in the following claims.

What is claimed is:

1. A vacuum cleaner assembly comprising:

an upright vacuum cleaner including an upright frame having an engagement end, a cleaning head, a first suction motor, and a first dirt cup, wherein the first suction motor is operable to create suction to draw air and dirt through the cleaning head and into the first dirt cup;

an adapter connected to the engagement end, the adapter including a projection opposite the engagement end; and a handheld vacuum cleaner including a second suction motor, a second dirt cup, and an elongate member having a nozzle end that forms a dirty air inlet, wherein an airflow pathway fluidly connects the dirty air inlet, the second suction motor, and the second dirt cup, and wherein at least a portion of the projection is removably received in the dirty air inlet that is formed by the nozzle end to removably couple the handheld vacuum cleaner to the upright vacuum cleaner.

2. The vacuum cleaner assembly of claim 1, further comprising a connection post coupled to the upright frame connecting the adapter to the engagement end of the upright frame.

3. The vacuum cleaner assembly of claim 2, wherein the engagement end of the upright frame includes a connection opening, the connection post received in the connection opening.

4. The vacuum cleaner assembly of claim 2, wherein the connection post is integral with the adapter.

5. The vacuum cleaner assembly of claim 2, wherein the connection post is configured to alternatively couple to a handle shaft in lieu of the adapter.

6. The vacuum cleaner assembly of claim 1, wherein the engagement end of the upright frame is configured to alternatively couple to a handle shaft in lieu of the adapter.

7. The vacuum cleaner assembly of claim 1, wherein the upright frame defines a longitudinal axis extending therethrough, and the projection extends away from the upright frame along the longitudinal axis.

8. The vacuum cleaner assembly of claim 1, wherein the adapter further includes a retainer member engaging the handheld vacuum cleaner when the projection is received in the nozzle end.

9. The vacuum cleaner assembly of claim 8, wherein the retainer member extends substantially parallel to the projection.

10. The vacuum cleaner assembly of claim 8, wherein the retainer member includes at least one tooth engaging the handheld vacuum cleaner.

11. The vacuum cleaner assembly of claim 10, wherein the retainer member further includes a user-engageable actuator, and user actuation of the actuator disengages the at least one tooth from the handheld vacuum cleaner.

12. The vacuum cleaner assembly of claim 10, wherein the at least one tooth is forced into engagement with the handheld vacuum cleaner.

13. The vacuum cleaner assembly of claim 10, wherein the handheld vacuum cleaner further includes a passage wall extending from the nozzle end, the passage wall has a passage wall thickness, a gap is defined between the at least one tooth and the projection, and the passage wall thickness of at least a portion of the passage wall is thicker than the gap.

14. The vacuum cleaner assembly of claim 1, wherein the handheld vacuum cleaner further includes a handle opposite the nozzle end, and the handle functions as the handle for the upright vacuum cleaner with the handheld vacuum cleaner coupled to the upright frame.

15. The vacuum cleaner assembly of claim 1, wherein the adapter further includes an adapter outer surface, the elongate member further includes an elongate member outer surface, and the adapter outer surface and the elongate member outer surface form a substantially tangential transition.

16. The vacuum cleaner assembly of claim 2, wherein the upright vacuum cleaner further includes a detent mechanism coupled to the connection post, the adapter further includes an aperture defined therein, and the detent mechanism at least partially occupies the aperture.

17. The vacuum cleaner assembly of claim 1, wherein the adapter includes:

an adapter body having an upright vacuum cleaner engagement end, the upright vacuum cleaner engagement end configured to connect the adapter to a portion of the upright vacuum cleaner;

a handheld vacuum cleaner engagement end opposite the upright vacuum cleaner engagement end, the handheld vacuum cleaner engagement end including the projection;

a peripheral wall about the adapter body between the handheld vacuum cleaner engagement end and the upright vacuum cleaner engagement end, the peripheral wall having an adapter outer surface;

a shoulder extending between the projection and the adapter outer surface; and a retainer member extending substantially parallel to the projection, the retainer member including a tooth extending toward the projection.

18. The vacuum cleaner assembly of claim 17, wherein:

a longitudinal axis extends through the upright vacuum cleaner engagement end and the handheld vacuum cleaner engagement end, and the projection extends in a direction along the longitudinal axis.

19. The vacuum cleaner assembly of claim 18, wherein a portion of the peripheral wall portion is substantially aligned with the retainer member in a direction along the longitudinal axis.

20. The vacuum cleaner assembly of claim 18, wherein at least a portion of the shoulder is inclined relative to a direction extending perpendicular to the longitudinal axis.

21. The vacuum cleaner assembly of claim 17, wherein the retainer member further includes a user-engageable actuator extending away from the projection.

22. The vacuum cleaner assembly of claim 17, wherein the entire adapter is formed as a single unitary part.

23. A vacuum cleaner assembly comprising:

an upright vacuum cleaner;

a handle attachment including a handle, and a handle shaft coupled to the handle, the handle shaft configured to removably couple to the upright vacuum cleaner; and an adapter configured to removably couple to the upright vacuum cleaner and to removably couple to a handheld vacuum cleaner, wherein the upright vacuum cleaner is configured such that only one of the handle shaft or the adapter can removably couple to the upright vacuum cleaner at a time.

24. The vacuum cleaner assembly of claim 23, wherein the upright vacuum cleaner includes an upright frame, and a connection post coupled to the upright frame, the connection post having a distal end, the handle shaft is configured to removably couple to the connection post, and the adapter includes a recess configured to removably receive the distal end of the connection post, and a projection opposite the recess, the projection configured to removably couple to the handheld vacuum cleaner.

25. The vacuum cleaner assembly of claim 24, further comprising the handheld vacuum cleaner including an elongate member having a nozzle end, at least a portion of the projection configured to be removably received in the nozzle end.

26. A vacuum cleaner assembly comprising:

an upright vacuum cleaner including an upright frame having an engagement end, a cleaning head, a first suction motor, and a first dirt cup, wherein the first suction motor is operable to create suction to draw air and dirt through the cleaning head and into the first dirt cup;

an adapter connected to the engagement end, the adapter including a projection opposite the engagement end;

a connection post coupled to the upright frame connecting the adapter to the engagement end of the upright frame, wherein the connection post is configured to alternatively couple to a handle shaft in lieu of the adapter; and a handheld vacuum cleaner including a second suction motor, a second dirt cup, and an elongate member having a nozzle end that forms a dirty air inlet, wherein an airflow pathway fluidly connects the dirty air inlet, the second suction motor, and the second dirt cup, and wherein at least a portion of the projection is removably received in the nozzle end to removably couple the handheld vacuum cleaner to the upright vacuum cleaner.

27. A vacuum cleaner assembly comprising:

an upright vacuum cleaner including an upright frame having an engagement end, a cleaning head, a first suction motor, and a first dirt cup, wherein the first suction motor is operable to create suction to draw air and dirt through the cleaning head and into the first dirt cup;

an adapter connected to the engagement end, the adapter including a projection opposite the engagement end, wherein the engagement end of the upright frame is configured to alternatively couple to a handle shaft in lieu of the adapter; and a handheld vacuum cleaner including a second suction motor, a second dirt cup, and an elongate member having a nozzle end that forms a dirty air inlet, wherein an airflow pathway fluidly connects the dirty air inlet, the second suction motor, and the second dirt cup, and wherein at least a portion of the projection is removably received in the nozzle end to removably couple the handheld vacuum cleaner to the upright vacuum cleaner.

* * * * *